US005860793A

United States Patent [19]

Muscarella et al.

[11] Patent Number: 5,860,793

[45] Date of Patent: Jan. 19, 1999

[54] DIAPHRAGM METERING PUMP WITH PUSH TO PRIME AIR BLEEDER VALVE

[75] Inventors: Stephen B. Muscarella, Geneseo; Philip T. Pascoe, Rochester; Francis J. Snyder, Ontario, all of N.Y.

[73] Assignee: Pulsafeeder, Inc., Rochester, N.Y.

[21] Appl. No.: 641,200

[22] Filed: Apr. 30, 1996

Related U.S. Application Data

[62] Division of Ser. No. 565,903, Dec. 15, 1995.

[51] Int. Cl.[6] ..... F04B 9/08; F04B 35/02

[52] U.S. Cl. ..... 417/388; 417/385

[58] Field of Search ..... 417/385, 388

[56] References Cited

U.S. PATENT DOCUMENTS

| | | | |
|---|---|---|---|
| 2,578,746 | 12/1951 | Scherger et al. | 417/388 |
| 3,056,423 | 10/1962 | Lieser | 137/493.7 |
| 3,612,727 | 10/1971 | Drake | 417/388 |
| 3,672,396 | 6/1972 | Pauliukonis | 137/512 |
| 3,920,042 | 11/1975 | Blatt | 137/523 |
| 4,252,094 | 2/1981 | Draxler | 123/198 DB |
| 4,273,310 | 6/1981 | Ginzler | 251/211 |
| 4,287,912 | 9/1981 | Hewett | 137/516.27 |
| 4,393,895 | 7/1983 | Rubey | 137/539.5 |
| 4,449,650 | 5/1984 | Sawatzki | 222/389 |
| 4,655,251 | 4/1987 | Nimberger | 137/516.29 |
| 4,736,768 | 4/1988 | Tsubouchi et al. | 137/514 |
| 4,776,430 | 10/1988 | Rule | 187/1.5 |
| 4,893,650 | 1/1990 | Chisholm et al. | 137/539 |
| 4,977,927 | 12/1990 | Hill | 137/539 |
| 5,044,391 | 9/1991 | Brumfield | 137/151 |
| 5,232,273 | 8/1993 | Eckstein et al. | 383/116.4 |
| 5,374,167 | 12/1994 | Merbold | 417/446 |
| 5,382,142 | 1/1995 | Spears | 417/443 |

FOREIGN PATENT DOCUMENTS

| | | | |
|---|---|---|---|
| 692303 | 8/1964 | Canada | 417/385 |

*Primary Examiner*—Richard E. Gluck

[57] ABSTRACT

A new and improved diaphragm metering pump is provided with a modular removable drive assembly. The removable drive assembly provides rotation to an eccentric shaft within the pump and is disposed outside rotary bearings for the eccentric shaft and outside sealing elements containing hydraulic fluid in the pump housing. In a preferred embodiment, a readily accessible mechanically activated hydraulic refill valve cartridge is provided to hydraulically balance the diaphragm. In a preferred embodiment, a push to prime air bleeder valve is provided permitting automatic priming of the hydraulic system without requiring disconnection of any valves. The pump is designed to interchangeably receive a number of diaphragm assemblies including an improved leak detection diaphragm and a double-sided leak detection diaphragm. In a preferred embodiment, a diagnostics window is provided permitting visual inspection of the operating condition of various valves connected to the hydraulic system.

4 Claims, 21 Drawing Sheets

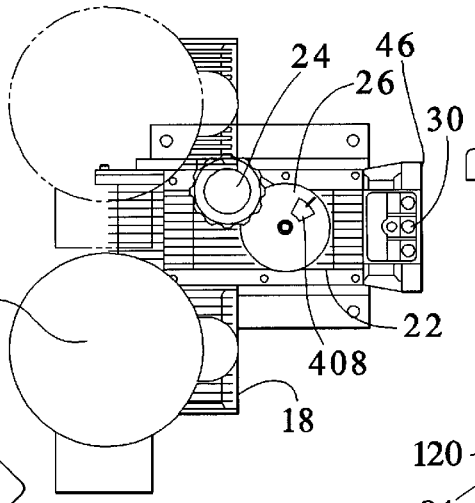
FIG. 3
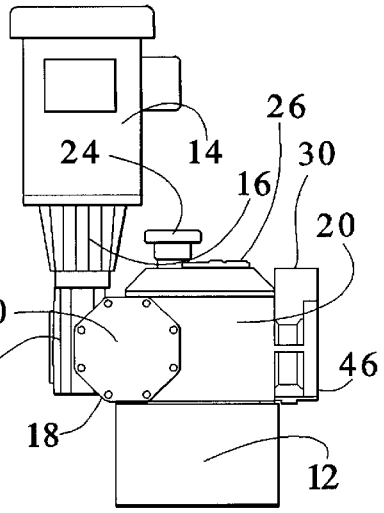
FIG. 2
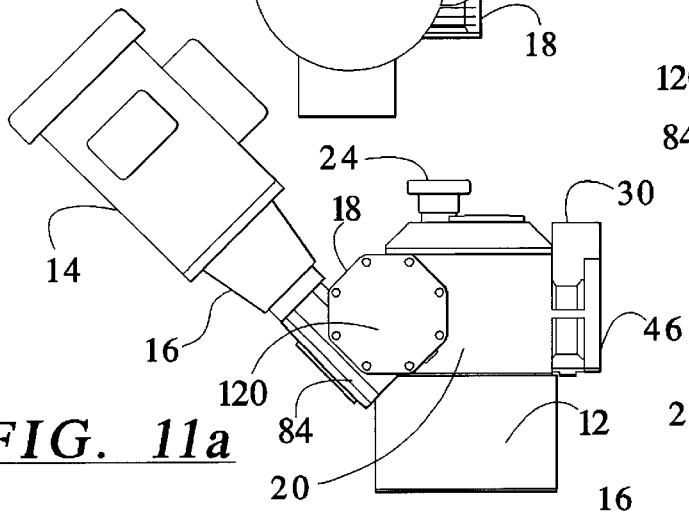
FIG. 11a
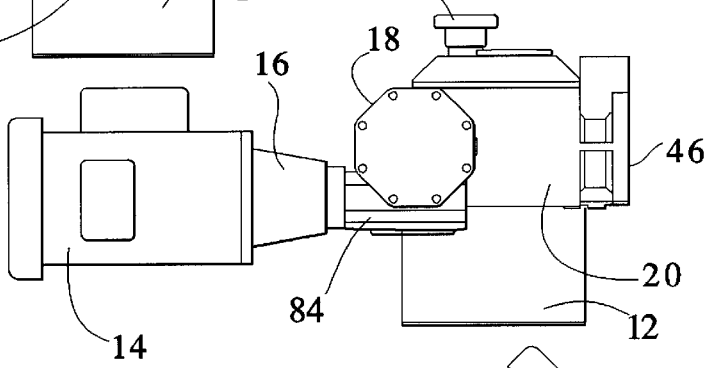
FIG. 11b
FIG. 11c
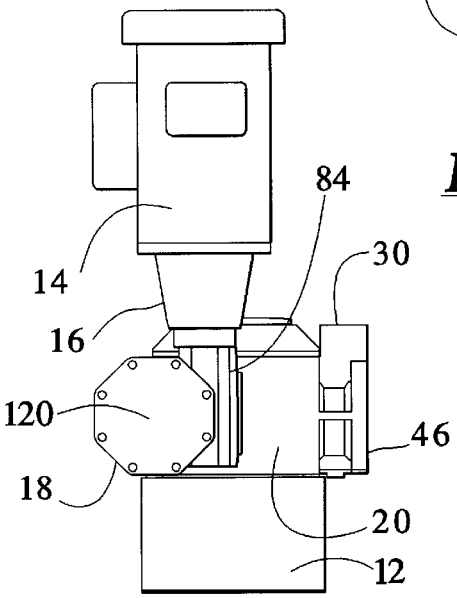
FIG. 11d
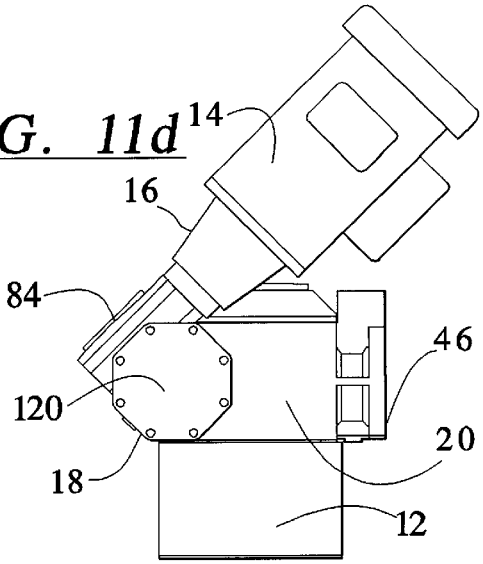

FIG. 7
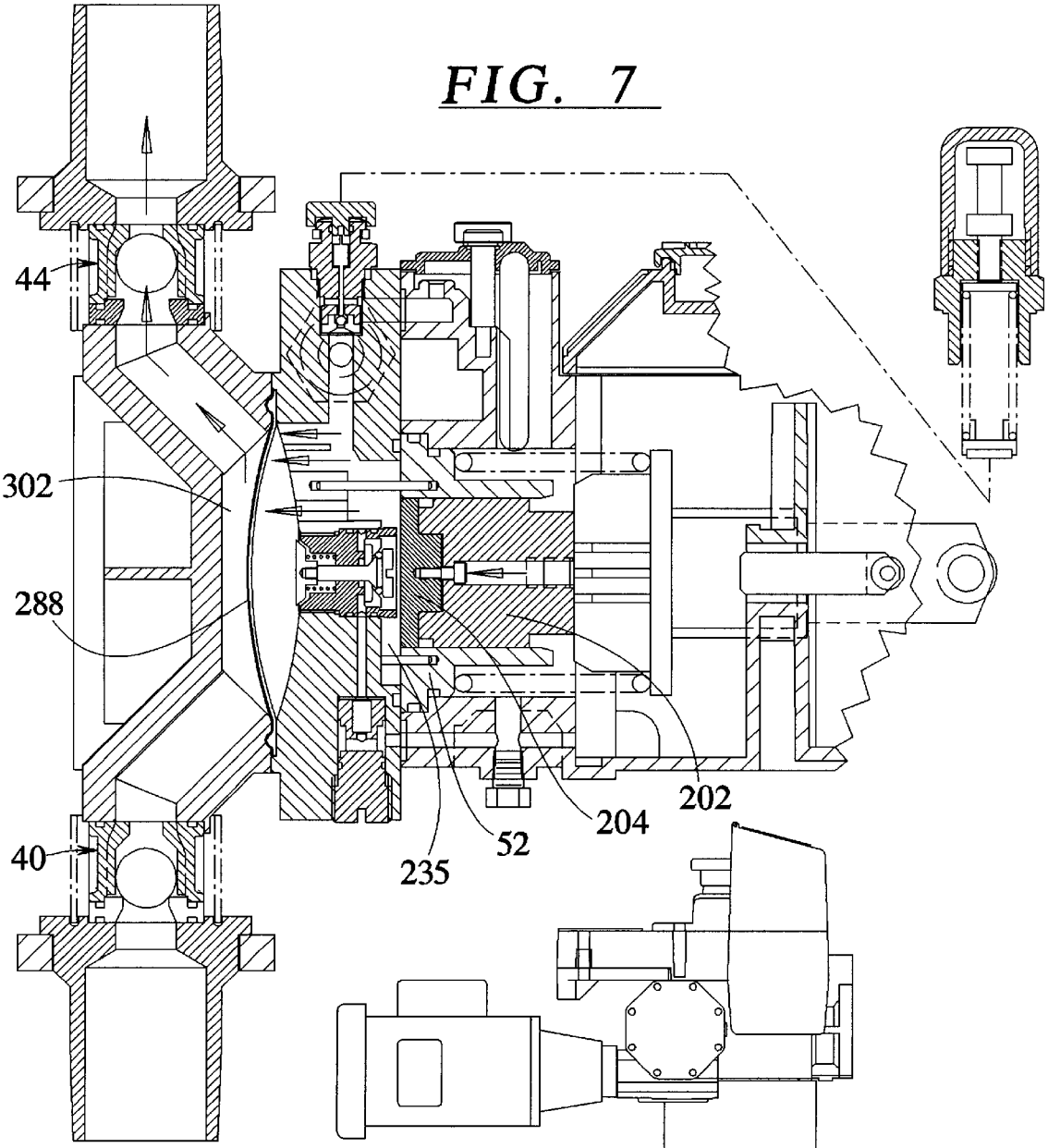
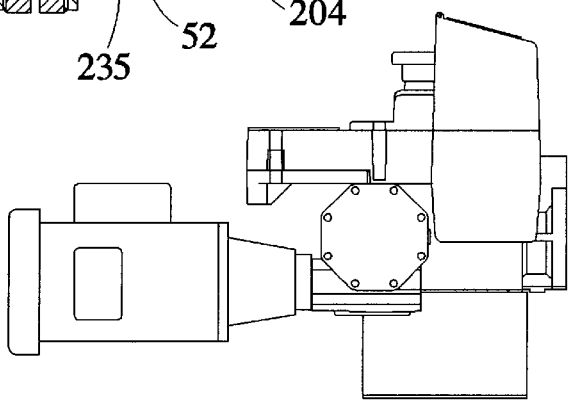
FIG. 12a
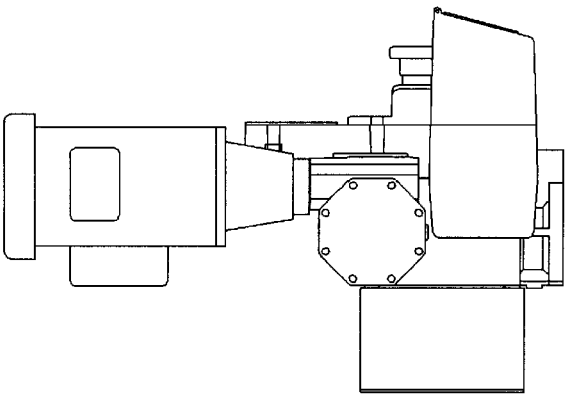
FIG. 12b

FIG. 13
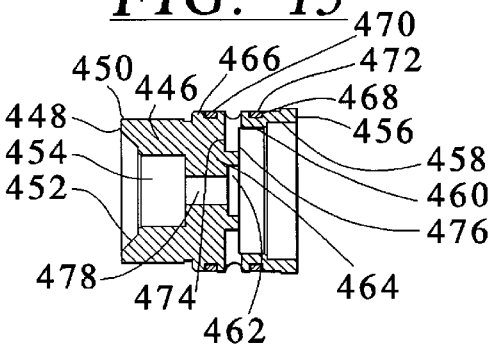
FIG. 14
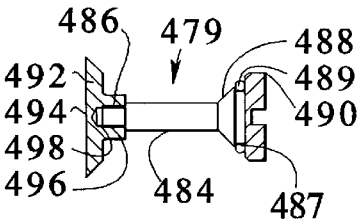
FIG. 15
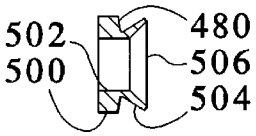
FIG. 16
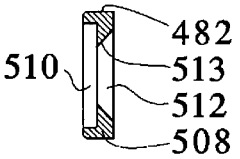
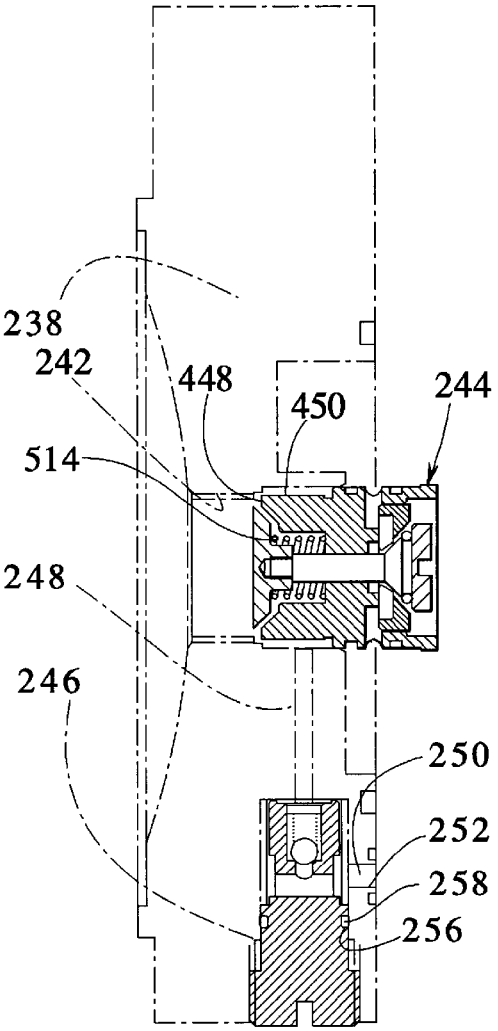
FIG. 17
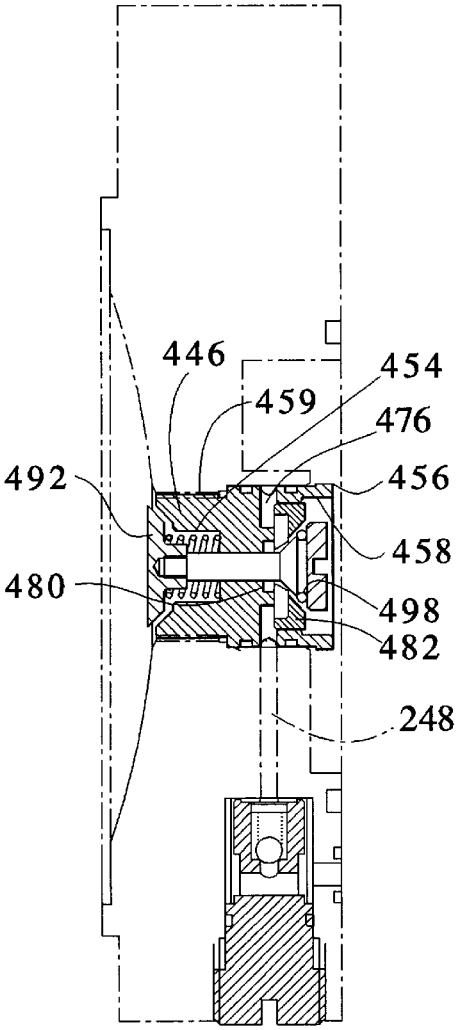
FIG. 18

436
434
432
430
420
426
428
424
440
444
440
442
422
438
442
432
424
444
438
442
444
432
438
442
424
438
432
444
442

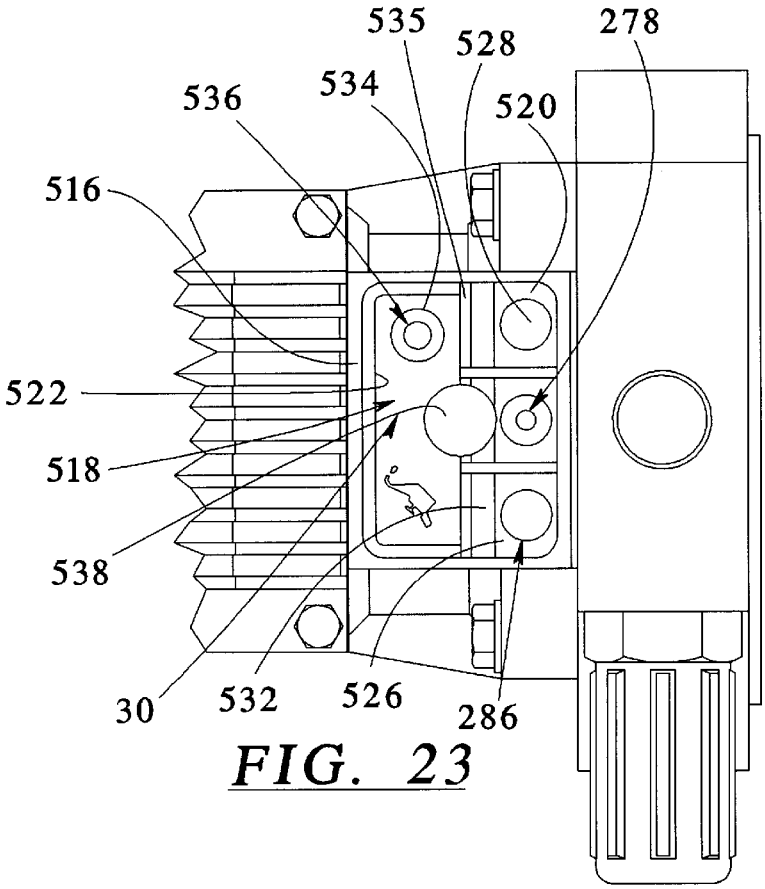
FIG. 23
FIG. 24
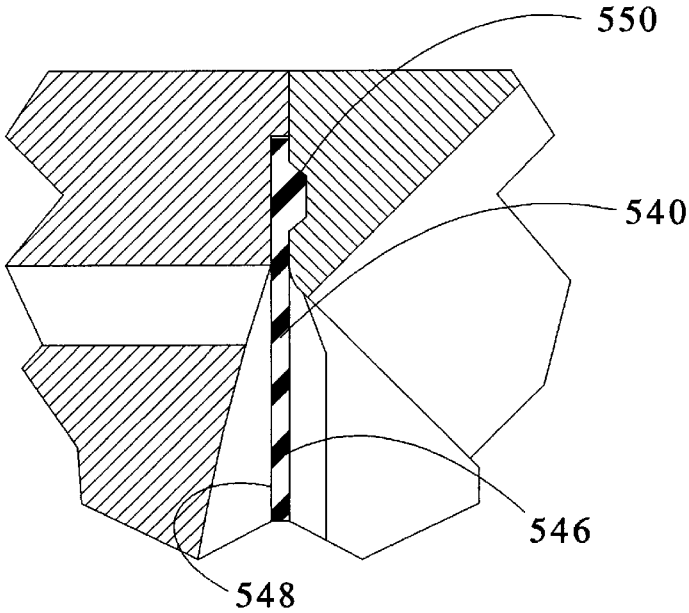

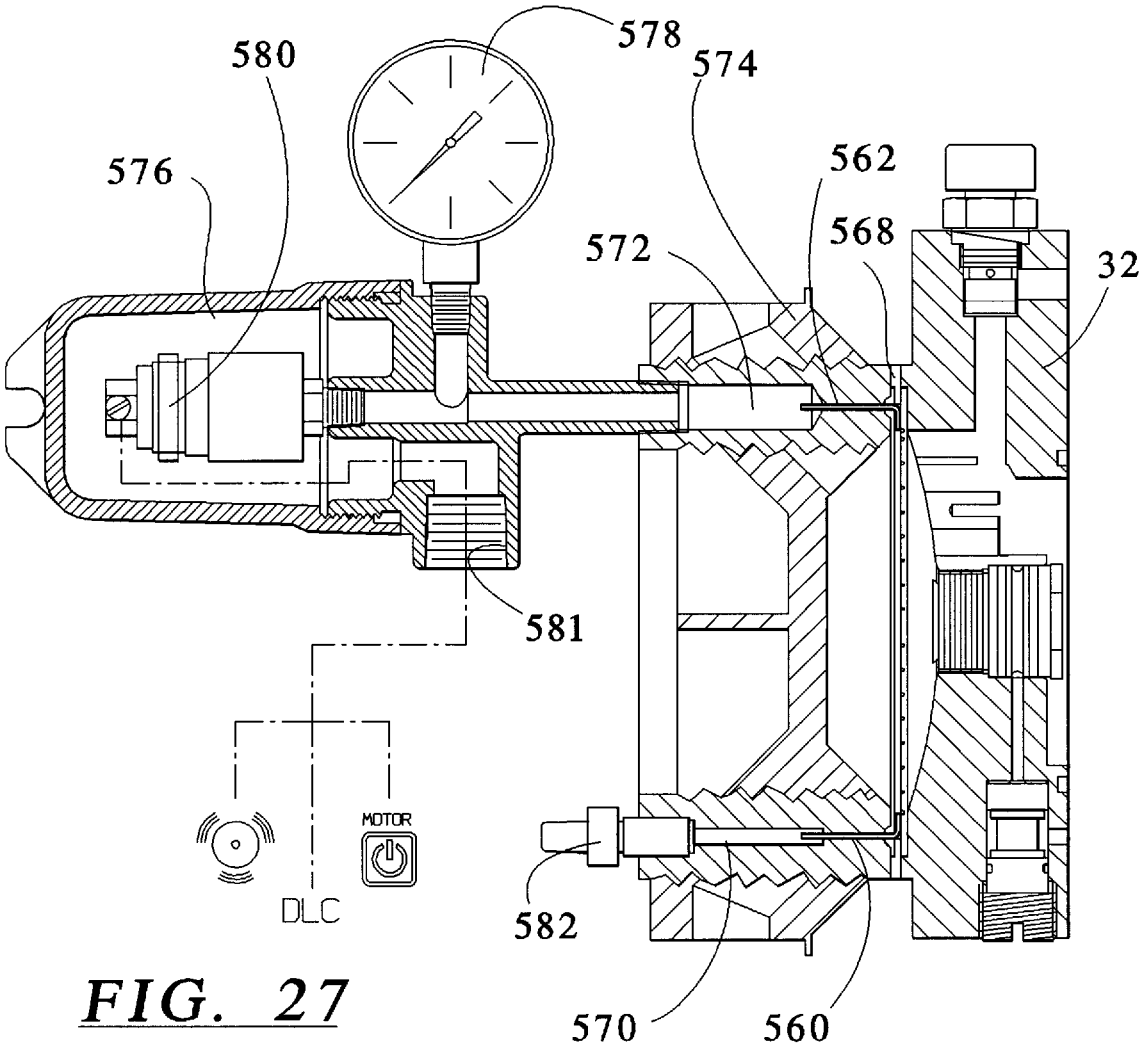
FIG. 27
FIG. 30
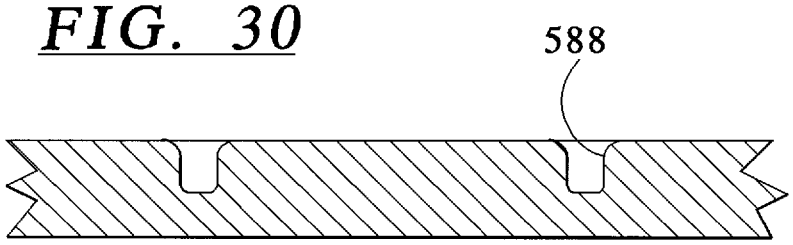

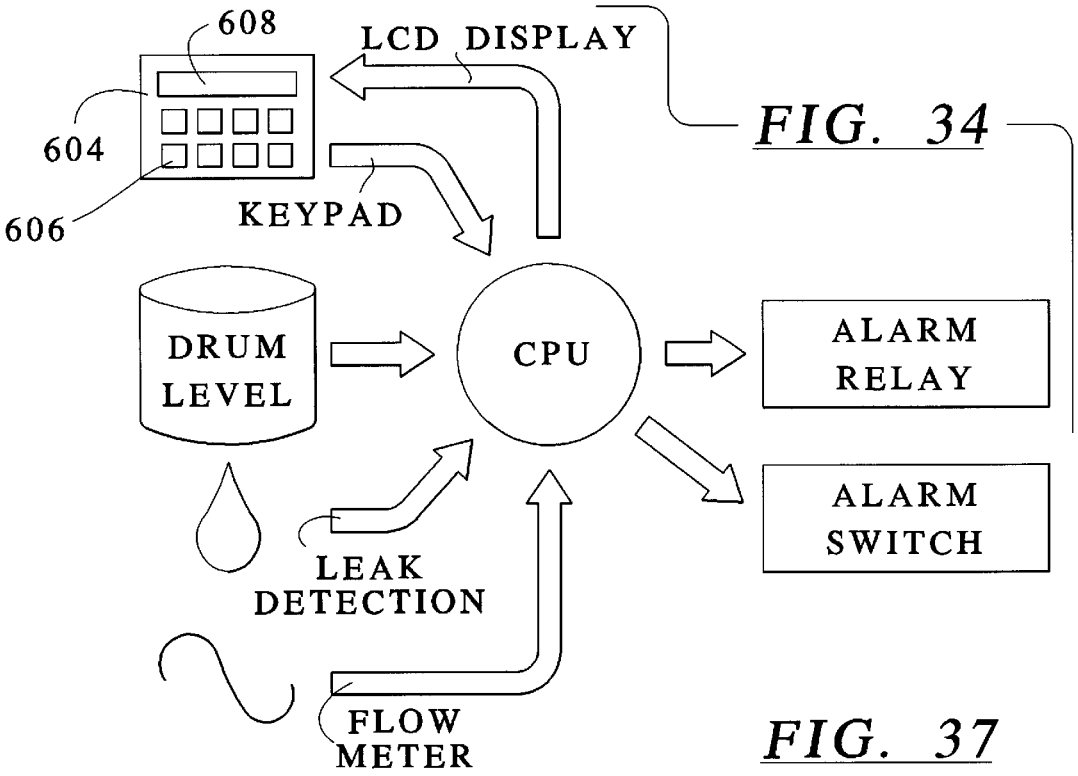
FIG. 34
FIG. 37
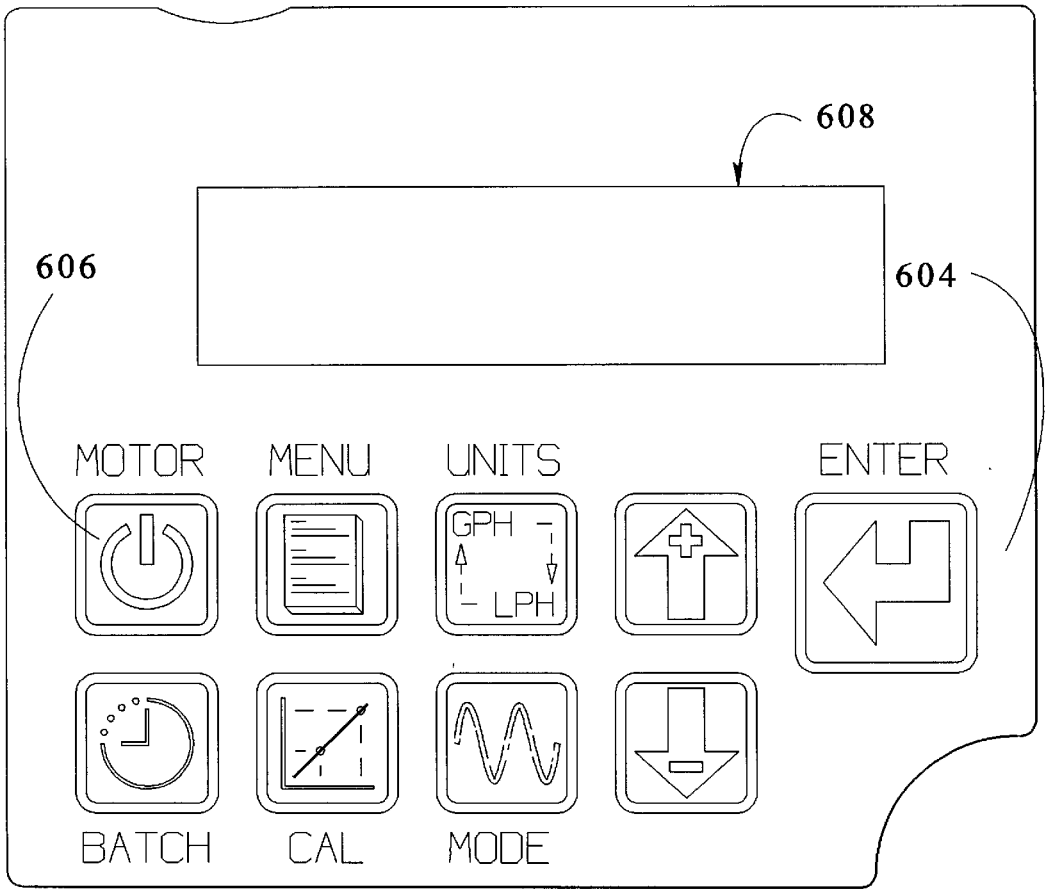

FIG. 39
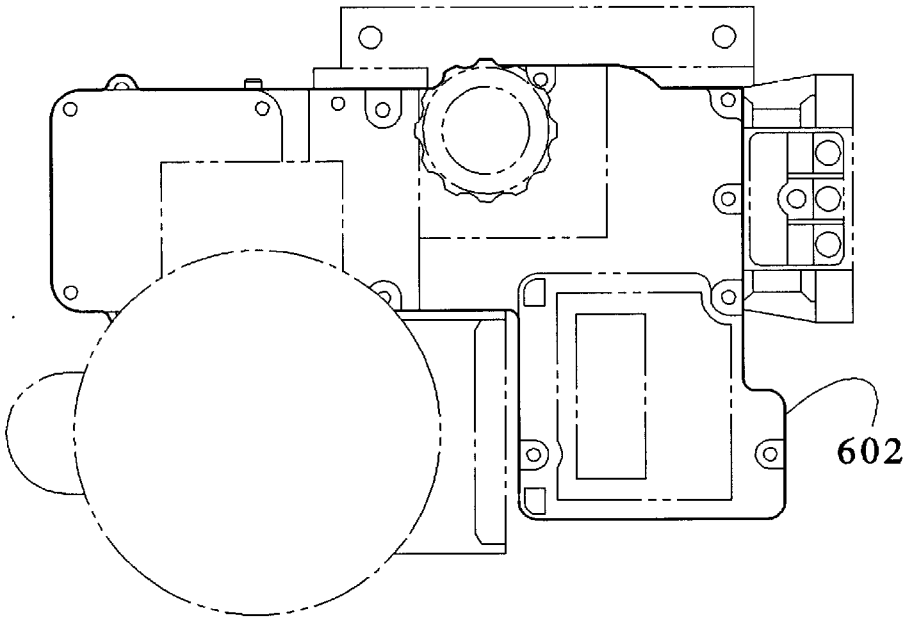
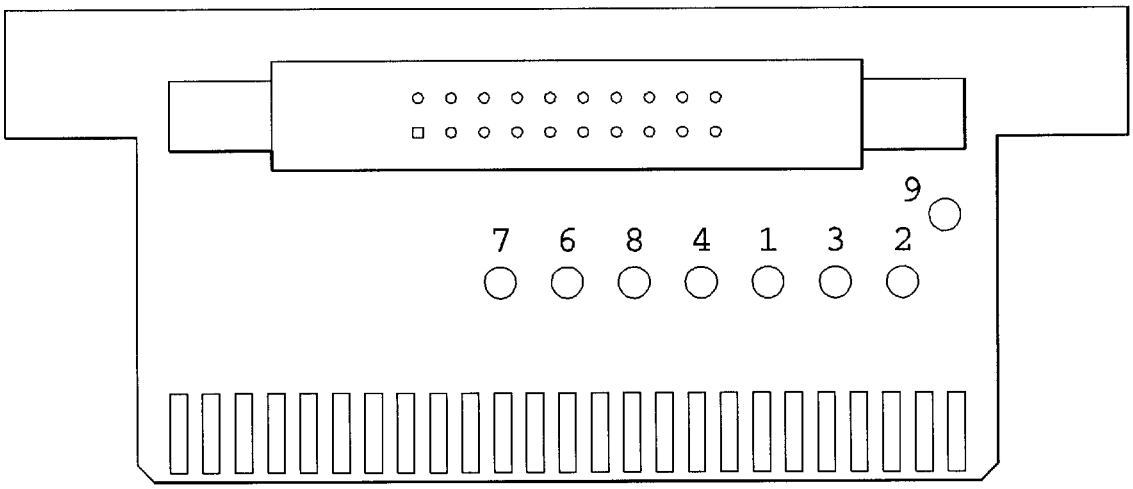
FIG. 40

DIAPHRAGM METERING PUMP WITH PUSH TO PRIME AIR BLEEDER VALVE

This is a division of application Ser. No. 08/565,903, filed Dec. 15, 1995.

BACKGROUND OF THE INVENTION

The present invention generally relates to diaphragm metering pumps for delivering controlled amounts of a liquid from a source of supply to a process stream or to another vessel. More particularly, it relates to a new and improved diaphragm metering pump having a versatile modular construction including a separated eccentric and drive system providing improved durability, as well as other advantageous hydraulic control features.

Diaphragm metering pumps are known and used for transferring fluids from one place to another. Generally, diaphragm pumps include a pumping head area including a product chamber and hydraulic chamber separated by a displaceable diaphragm member. The inlet and exit to the product chamber are provided with one-way check valves. As the diaphragm is displaced toward the hydraulic side, the exit check valve closes under reduced pressure, the inlet check valve opens and fluid is drawn into the product chamber. Thereafter, as the diaphragm is displaced from the hydraulic side toward the product side, pressure increases on the fluid in the product chamber, closing the inlet check valve, opening the outlet check valve, and forcing fluid in the product chamber out of the exit. In continuous operation, a diaphragm pump pumps fluid through the product side in a pulsed manner.

Diaphragm displacement is achieved by varying the pressure of the hydraulic fluid on the hydraulic side through the operation of a reciprocating piston disposed in fluid communication with the hydraulic chamber. Proper long-term operation requires that the diaphragm be hydraulically balanced. Excess pressure on either side of the diaphragm can lead to irregular pumping action and excess displacements of the diaphragm, which may cause catastrophic failure of the diaphragm or shortened use life. A frequently used method for preventing excess displacements of the diaphragm has been to provide contoured dish plates on the product and hydraulic side of the diaphragm to positively limit displacement of the diaphragm by providing a physical barrier to further travel.

Prior efforts to provide a hydraulically balanced diaphragm pump have included the use of a spring-loaded pressure relief valve disposed in fluid communication with the hydraulic cavity. The pressure relief valves are designed to open when the pressure level of the fluid in the hydraulic chamber exceeds a predetermined value. The pressure relief valve opens to remove some hydraulic fluid from the hydraulic chamber to reduce the pressure therein. This prevents undesirable overdisplacement of the diaphragm toward the product side during pumping.

In addition, if the volume or pressure of the hydraulic fluid in the hydraulic chamber on the suction stroke of the piston is too low, the diaphragm can be displaced an excessive amount into the hydraulic chamber. In these circumstances, additional hydraulic fluid should be introduced into the hydraulic chamber to balance the diaphragm. Pressure sensitive valves are often used for this purpose. It has been proposed to provide a poppet valve located on the hydraulic side dish plate, which is effective to add make-up hydraulic fluid to the hydraulic chamber when displacement of the diaphragm becomes large enough to physically contact and press against the poppet valve. These mechanically actuated poppet valves are useful but a major disadvantage of prior art pumps is that the poppet valves are not accessible without disassembling the pump and many of the sealed connections therein. Moreover, no detectable information as to the condition of these valves is provided in most systems, so proper functioning of the valve is hard to discover or diagnose.

Another factor which may influence hydraulic balance in the system is the development or presence of gas in the hydraulic fluid on the hydraulic side of the diaphragm. The presence of gas in the hydraulic chamber may lead to irregular pumping action. For example, the action of the piston may compress a gas present in the hydraulic chamber rather than driving the diaphragm. Accordingly, an air bleeder valve is usually provided in an upper portion of the hydraulic chamber. The air bleeder valve may be provided in the form of a shuttle check valve which permits discrete volumes of air or fluid to be removed from the hydraulic chamber on each forward compression stroke of the piston to maintain the hydraulic cavity air bubble free.

A major problem with prior efforts for providing hydraulically balanced diaphragms has to do with priming the system for start-up. In the past, many of these valves had to be removed and hydraulic fluid manually loaded into the chamber. Thereafter, the pumps need to be operated for some time to bleed any air out of the system and permit the system to come to a hydraulically balanced state. During the start-up procedure, all of the valves may be activated and the pump typically begins operation in an unbalanced manner for a certain period of time which provides undesirable stress and wear on the diaphragm and other parts making up the system.

The drive mechanisms employed for moving the piston generally employ rotation of a shaft provided by an electric motor which is translated into reciprocating linear motion of the piston. Although various linkage arrangements between the drive shaft and the piston rod have been used, more frequently reciprocal movement of the piston is achieved by means of an eccentric cam surface provided on the rotating shaft which is combined with a spring-loaded cam follower on the piston rod. In these prior arrangements, the eccentric drive shaft has frequently been provided in an assembled form with several components mounted on the shaft. The eccentric and other elements mounted onto the shaft, given the pressures present in the system, may frequently loosen in use, requiring service.

Rotation of the eccentric shaft is frequently provided by a worm and worm gear combination wherein the worm gear is provided on the eccentric shaft. This arrangement has several disadvantages. First of all, the lubricant required for gearing connections between the worm gear and the worm require a first grade or quality gearing lubricant. The hydraulic mechanism requires a different viscosity hydraulic fluid. In the past because these two features were combined on the same shaft, a mixed fluid was used which was not completely satisfactory for either function. Moreover, when the eccentric and worm gear are on the same shaft, the bearing support spacing for the eccentric shaft is wider, causing shaft deflection stresses. As a result, bearing life may be reduced due to angular misalignment of the eccentric shaft due to deflection. These prior drive systems may suffer from premature wear and do not possess the durability desired for long-term operation of the drive system.

Another effort at providing long-term, trouble-free operation for diaphragm pumps has led to the use of a double-layer diaphragm. The use of two diaphragm layers provides better protection against contamination of the product fluid or the drive fluid in the event of a diaphragm leak or failure since it is unlikely that both diaphragms will fail at the same time. In accordance with this arrangement, the back-up diaphragm is present to prevent unwanted contamination of the fluid.

It has also been proposed to provide a leak detection system for double diaphragm arrangements wherein the gap between the diaphragms is evacuated to reduced pressure and gap pressure is monitored. If a diaphragm leak occurs, the reduced pressure in the gap will go up which may be detected by a pressure monitoring means such as a pressure gauge or switch. In prior art leak detection systems, after evacuation, the central portions of the diaphragms are drawn together which may actually seal small leaks which go detected. Accordingly, these systems are unable to detect minor leaks in the central regions of the diaphragms. In addition, rubbing of the adjacent diaphragm surfaces sometimes cause particulate debris to build up in the gap which can plug sensing channels between the gap and sensing means. If this occurs, leaks can go undetected by the monitoring system. Accordingly, a leak detection system capable of early detection of leaks anywhere on the diaphragm surface which is not susceptible to plugging is still desired.

Prior art diaphragm pumps generally provide the drive system within the pump housing which requires the housing to be undesirably large. The large size of these pumps may limit positioning and placement of the pumps, which is a major drawback to their use. In addition, prior pumps employed external tubing to connect various valves to various reservoirs and chambers, which is not only unattractive but undesirable from the standpoint of tangling, snaring, and external leaks.

In order to overcome the shortcomings of the prior art diaphragm pumps, it is an object of the present invention to provide a hydraulically balanced diaphragm pump which may be primed automatically and internally without the need to remove valves at start-up.

It is another object of the present invention to provide a hydraulically balanced diaphragm pump having a mechanically actuated hydraulic fluid make-up valve on the hydraulic side which is provided in a readily accessible cartridge for easy examination and servicing.

It is a further object of the present invention to provide a diaphragm pump wherein the condition of each of the valves employed in hydraulic balancing may be visually observed during operation of the pump.

It is another object of the present invention to provide a new and improved drive system wherein the gear reducer and pump housing are separated so that each may be lubricated by their own proper lubricants.

It is a further object of the present invention to provide a smaller diaphragm pump housing having modular features such that the drive connections may be made in several orientations to meet various height and space requirements.

It is still another object of the present invention to provide a new and improved diaphragm pump having a double diaphragm assembly which provides a method for detecting leaks in the diaphragms in use.

It is still a further object of the present invention to provide a modularized diaphragm metering pump adapted to accept either electronic or manual controls for regulating pump operation.

SUMMARY OF THE INVENTION

In accordance with these and other objects, the present invention provides a new and improved diaphragm metering pump possessing a number of advantageous features. More particularly, the new and improved diaphragm metering pump in accordance with the present invention comprises a diaphragm metering pump including an eccentric shaft and a removable drive system wherein the removable drive system is disposed outside rotary bearings for the eccentric shaft and outside sealing elements containing hydraulic fluid.

In an embodiment, a pump in accordance with the invention may comprise a pump housing including a front end with an opening, an opposed rear end, and a pair of parallel spaced sidewalls extending between and connecting the front end and rear end. An elongate hollow cylinder member having a forward end with an opening and a rearward end with an opening is sealingly mounted in the front end opening of the pump housing. The pump housing may further include an open topped eccentric cavity defined therein. A lid or detachable cover member may be provided to close the top opening of the eccentric cavity. A pair of aligned eccentric mounting apertures are provided in each sidewall adjacent the rear end of the pump housing which communicate with the eccentric cavity.

In an embodiment, the diaphragm metering pump in accordance with this invention further comprises a pump head including a front end with an opening, an opposed rearward end with a rear opening and a hydraulic chamber defined therein extending from the front opening to the rear end opening. The pump head is sealingly and releasably mounted to the front end of the pump housing so that the rear end opening is disposed in registration with the front end opening of the pump housing.

A piston is sealingly engaged in the cylinder member in the pump housing. The piston is mounted for reciprocal movement within the cylinder member between a forwardly extended position, wherein the piston lies adjacent the front end of the cylinder member, and a rearwardly retracted position, wherein the piston is spaced rearwardly from the front end of the cylinder member.

In an embodiment, the pump further comprises a resilient, flexible diaphragm member having first and second opposed major surfaces. The diaphragm is mounted to the front end of the pump head in sealed engagement therewith so that the first major surface of the diaphragm closes the front end opening of the pump head leading to the hydraulic cavity.

In an embodiment, the pump further includes a product head having a front end, an opposed rear end with an opening, and a fluid flow passageway defined therein. The fluid flow passageway extends from an inlet end having a one-way check valve to an outlet end having a one-way check valve. An intermediate portion of the fluid flow passageway communicates with the opening in the rear end of the product head, thereby defining a product chamber. The product head is sealingly and releasably mounted to the front end of the pump head and diaphragm member so that the second major surface of the diaphragm closes the opening in the rear end of the product head.

In accordance with the present invention, a separate gear reducer housing is provided. In an embodiment, the gear reducer housing includes a front end with an opening, a worm rotatably mounted therein for rotation about a first axis, and a worm gear. The worm gear includes a pair of hub extensions projecting outwardly from the opposed side of the worm gear and defining a hollow hub portion extending through the worm gear. The hub portion includes inwardly directed gear teeth. The worm gear is mounted for rotational movement about a second axis extending generally perpendicular to the first axis. The gearing on the worm gear is engaged with gearing provided on the worm. The gear reducer housing is sealably and releasably mounted to the pump housing so that the front end opening of the gear reducer housing is disposed in alignment with one of the eccentric mounting apertures provided in the pump housing.

In an embodiment, the pump further includes a unitary elongated eccentric shaft member having a first end provided with a spline portion, an opposed second end, and an eccentric solid having a cam surface disposed intermediate the first and second ends. The first end of the shaft member is rotatably, sealingly received through the eccentric mounting aperture and the front opening of the gear reducer housing, so that the spline portion thereon is cooperatively engaged with the gear teeth of the hub portion of the worm gear. The eccentric solid is disposed within the eccentric cavity of the pump housing. The second end of the shaft member is disposed in the opposing eccentric mounting aperture provided in the pump housing. An aperture cover plate including a cylindrical sleeve projection extending from the side thereof is sealingly and releasably mounted over the opposing eccentric mounting aperture so that the second end of the eccentric shaft member is rotatably engaged in the cylindrical sleeve projection.

In an embodiment, the new and improved diaphragm metering pump in accordance with this invention further includes an elongate crosshead rod in the eccentric cavity having a first end connected to a rear side of the piston, an opposed second end including a cam follower roller, and a radially projecting flange having a radial bearing surface facing the first end of the crosshead rod disposed intermediate the first end and second end of the crosshead rod.

In an embodiment, a spring or other biasing member is disposed between the front end of the cylinder member and the radial bearing surface of the flange on the crosshead rod. The biasing member biases the flange away from the pump head which maintains the cam follower roller in contact with at least a portion of arc of the cam surface on the eccentric solid during rotation of the eccentric. The biasing member also urges the piston to return to a normally retracted position.

In an embodiment, the pump further includes a hydraulic fluid disposed in the hydraulic chamber and preferably also in a hydraulic fluid reservoir provided in the pump housing. In accordance with a preferred embodiment, two radial lip seals are provided between the pump housing and gear reducer housing to provide redundant sealing and isolation between gear lubricant and hydraulic fluid. This permits an edible or food approved oil to be employed as the hydraulic fluid so that the pump may be used in food production applications. Gear lubricant can be provided in the gear reducer housing which is closed and sealed so that it does not intermix with the hydraulic fluid in the pump housing.

In an embodiment, the pump also includes a means for rotating the worm which may be, for example, either an AC or DC electric motor or other motor. The motor may be mounted to the gear reducing housing by means of a motor mount which couples the motor to the worm to provide rotation to the worm.

In an embodiment, rotation of the worm causes rotation of the worm gear in the gear reducer housing. Rotation of the worm gear by means of the hub and spline arrangement imparts rotation to the eccentric shaft. Rotation of the eccentric shaft causes reciprocal translation of the crosshead rod against the biasing means which also causes reciprocal movement of the piston between the retracted and extended positions. Movement of the piston against the hydraulic fluid causes displacement of the diaphragm so that as the piston is moved from the retracted position to the extended position, the diaphragm is displaced forwardly into the rear end opening of the product head. This is effective to open the outlet check valve, close the inlet check valve and force fluid present in the fluid flow passageway out of the outlet end thereof. As the piston is moved from its extended position to its retracted position, the diaphragm is displaced rearwardly into the front end opening of the pump head which is effective to close the outlet check valve, open the inlet check valve and suction fluid through the inlet end into the fluid flow passageway. On subsequent movement of the piston from the retracted position to its extended position, the fluid in the fluid flow passageway is pumped out the outlet end and in this manner a diaphragm pump capable of moving fluid through the fluid flow passageway is provided.

In accordance with a preferred embodiment, the eccentric mounting apertures provided in the pump housing and the front face on the gear reducer housing are each provided with a mating octagonal configuration. By means of this arrangement, the gear reducer housing may be attached to either side of the pump housing as may be required by the end user. Moreover, the relative orientation of the motor mount may be positioned as desired by rotating the octagonal face of the gear reducer housing in a variety of 45° rotational increments to configure the pump drive mechanism so that it meets almost any space requirements of the customer. In accordance with another preferred feature, the double-sided hub of the worm gear permits duplexing or multiplexing so that two eccentric shafts in two pump housings may be run off the same drive mechanism. In accordance with another preferred feature, the worm gear mounting arrangement within the gear reducer housing is simpler with less expensive bearings. Changeover of gearing may also be readily accomplished by the customer.

In an embodiment, the new and improved diaphragm metering pump of this invention further includes a diagnostic window located at the top of the pump housing to permit ready visual inspection of various aspects of the pump operation while the pump is in use. In accordance with this embodiment, a pressure relief valve is provided in fluid communication with the hydraulic chamber whose outlet is fluidly connected to an orifice disposed within the viewing window of the pump housing. Any discharge of hydraulic fluid through the pressure relief valve will thus be visually observable through the diagnostic window. Moreover, the pump is preferably provided with an air bleeder valve for removing air and fluid from an upper portion of the hydraulic chamber which is also ported internally to an orifice disposed adjacent the diagnostic window. Preferably, the air bleeder valve is a shuttle check valve including a ball check which shuttles back and forth between upper and lower seats. On each stroke of the pump, a small amount of fluid or air can be removed from the hydraulic system and expelled through the valve, which is ported to the diagnostic window. The presence of air bubbles or hydraulic fluid flowing through the port can provide a ready indication of the condition of the hydraulic system. In addition, in accordance with this preferred embodiment, the pump is preferably provided with a mechanically actuated hydraulic refill valve having a modular cartridge configuration which is readily installed in a contour plate provided in the pump housing head. The cartridge valve is preferably a poppet valve system provided with a new and improved shaft seal for a more reliable leak-free operation. In accordance with this embodiment, leakage in the refill valve, should it occur is also detectable at the diagnostics window. More particularly, leakage around the refill valve will cause a continuous flow of hydraulic fluid to be observed at the pressure relief valve output port located in the diagnostics window. Moreover, the diagnostics window can also be provided with an indicator showing the hydraulic fluid fill level of the hydraulic reservoir.

In accordance with another embodiment, the new and improved diaphragm pump is provided with a diaphragm assembly equipped with a leak detection system. More particularly, in accordance with this embodiment, the diaphragm assembly includes first and second generally circular diaphragms clamped or joined together with an intermediate peripheral spacer member therebetween. A tube is positioned through the spacer member to communicate with the gap located between the two diaphragm surfaces. The inner space located between the diaphragms may then be evacuated to a reduced pressure or vacuum to draw the opposing surfaces of the diaphragm together so that a major portion of the surface areas of the diaphragms will move together as a single unit. A pressure gauge and/or pressure switch can be connected to the evacuation system to indicate when the reduced pressure or vacuum between the two diaphragms is lost indicating a perforation or diaphragm failure in one of the diaphragm surfaces.

In accordance with a preferred embodiment, the inwardly facing contact surfaces of the diaphragms are provided with a spiral groove which is effective to provide and maintain fluid communication from the center functioning surfaces of the diaphragms to the pressure monitoring means permitting early leak detection anywhere along the diaphragm surfaces.

In an especially preferred embodiment, the diaphragm assembly includes three diaphragm layers having two leak detection gaps located on either side of a central diaphragm. The space between each outer diaphragm and central diaphragm is evacuated and monitored with a pressure gauge or switch to provide an indication as to which side of the diaphragm has failed. This feature provides a way of determining whether a diaphragm leak has occurred and whether the leak has occurred on the product fluid side or the hydraulic fluid side of the diaphragm.

In an embodiment, the new and improved diaphragm metering pump of this invention is provided with a new and improved push to prime air bleeder valve. In accordance with this embodiment, a shuttle check air bleeder valve is provided with a valving rod which can be moved to a position which prevents the ball check from seating on the upper seat. This converts the shuttle check valve into a one-way check valve. In this mode, on each forward stroke of the pump piston, large amounts of hydraulic fluid or air may be expelled through the bleeder valve unchecked. On return of the piston during the suction stroke, the valve checks on the lower seat and new hydraulic fluid is drawn into the hydraulic system through the refill make-up valve. Subsequent stroking of the piston with the valve maintained in this position permits the hydraulic system to be filled in an automatic manner without requiring removal of the valve to fill the hydraulic system.

In accordance with a preferred embodiment, the refill valve is fluidly connected to a hydraulic fluid reservoir located in the pump housing. The hydraulic fluid reservoir may simply be filled by removing the cover to the diagnostics window and filling the fluid directly. In accordance with this aspect of the invention, a self-priming hydraulic system is provided.

In accordance with still another embodiment, the new and improved diaphragm pump of this invention includes a stroke length adjustment assembly which is modularly adapted to receive either a manual or an electronic control. In accordance with this embodiment, the stroke length of the piston can be shortened, thereby reducing the quantity of fluid taken in through the product inlet on each suction stroke of the piston. This stroke length adjustment is accomplished by limiting rearward travel of the crosshead flange which limits rearward travel of the piston through loss of motion obtained by compressing the biasing member. In accordance with this embodiment, as the piston and crosshead return under the influence of the biasing spring to the retracted position, an actuator rod can be moved to a location which abuts against the radial flange on the crosshead member preventing further rearward travel of the crosshead and piston. Limiting rearward travel of the crosshead provides that for a portion of the revolution of the eccentric, the cam roller follower on the end of the crosshead rod is not engaged on the eccentric surface.

In accordance with this embodiment, the stroke length adjustment assembly is provided by a three-sided upstanding sidewall disposed in the eccentric cavity which cooperates with the sidewall of the eccentric cavity to define a vertical passageway. A threaded shaft is rotatably mounted for continuous bi-directional rotation within the vertical passageway. A cam member having a threaded aperture is threadedly engaged onto the threads of the rotatable shaft. The cam member rides upwardly or downwardly within the vertical passageway on rotation of the rotatable shaft in either direction. The cam body has a forwardly facing angled cam surface. An actuator rod is mounted for reciprocal lateral movement through the front panel of the upstanding sidewall defining the vertical passageway. A front end of the actuator rod abuts against the flange on the crosshead rod. A rearward end of the actuator rod is provided with a cam follower roller which is positioned to ride on the angled cam surface of the cam member within the vertical passageway. Rotation of the vertical shaft member moves the cam solid upwardly or downwardly within the passageway which causes the cam follower roller riding on the angled surface to move the actuator rod forwardly or rearwardly to adjust the limit of rearward travel of the crosshead and piston, thereby providing adjustment of the stroke length. In this manner, the stroke length may be adjusted downwardly from 100% to any smaller percentage increment of stroke length desired. The means for rotating the threaded rotatable shaft within the vertical passageway may be either manual or electronic. In a manual embodiment, a spring-loaded push-to-turn hand knob may be provided to impart rotation to the threaded shaft member. The hand knob springs to a locked position to maintain a set adjustment. Alternatively, a synchronous motor actuator may be provided for adjustably rotating the vertical shaft member to provide stroke length adjustment, which can be interactively connected to a pump system controller.

In an embodiment, the new and improved diaphragm metering pump is provided with a modularized design providing increased durability and flexibility for use. In a preferred embodiment, the diaphragm metering pump includes a number of redesigned valves adapted for improved operation. A diagnostics window provides ready visual inspection of various aspects of pump operation. Most of the pumping operations may be brought under the control of the digital logic controller which can regulate the motor speed and stroke length as well as time and duration of operation. Adjustment of operation and programming can be provided through a simple keypad equipped with an LCD display connected to the digital logic controller making the pump more user friendly. The modularized design of the pump permits easy assembly and is specifically designed to permit partial disassembly and access to various parts without requiring disassembly of major sealed components of the pump to facilitate examination, changeover and maintenance. All of these features combine to provide a new and improved diaphragm metering pump capable of providing extended high-quality operation.

Other objects and advantages of the present invention will become apparent from the following detailed description of the invention, taken in conjunction with the drawings in which:

BRIEF DESCRIPTION OF THE DRAWINGS

FIG. 2 is a side elevation view of the new and improved diaphragm metering pump of the present invention in accordance with the embodiment of FIG. 1, with the pump head and product head portions removed;

FIG. 3 is a top plan view of the new and improved diaphragm metering pump of this invention as shown in FIG. 2;

FIG. 7 is a fragmentary elevated cross-sectional view of the front end portion as in FIG. 6, showing the pump in its discharge position;

FIGS. 11(*a*)–11(*d*) are side elevation views of the new and improved diaphragm metering pump of FIG. 1, illustrating various pump configurations made possible by the modular design of the pump components;

FIGS. 12(*a*)–12(*b*) are side elevation views of the new and improved diaphragm metering pump of FIG. 8, illustrating various pump configurations made possible by the modular design of the pump components;

FIG. 13 is an elevated cross-sectional view of the new and improved hydraulic refill valve cartridge housing in accordance with a preferred embodiment;

FIG. 14 is a side elevation view of the new and improved poppet valving rod assembly for use in the hydraulic refill valve cartridge in accordance with a preferred embodiment;

FIG. 15 is an elevated cross-sectional view of the new and improved shaft seal for use in the hydraulic refill valve cartridge in accordance with a preferred embodiment;

FIG. 16 is an elevated cross-sectional view of the new and improved valve seat for use in the hydraulic refill valve cartridge in accordance with a preferred embodiment;

FIG. 17 is an elevated cross-sectional view of the assembled hydraulic refill valve cartridge in accordance with a preferred embodiment shown at the beginning stages of installation in a hydraulic contour plate shown in phantom lines;

FIG. 18 is an elevated cross-sectional view of the new and improved hydraulic refill valve cartridge in accordance with a preferred embodiment similar to FIG. 17 showing the valve cartridge in its fully installed position;

FIG. 23 is a fragmentary top plan view of the new and improved diagnostics window in accordance with a preferred embodiment;

FIG. 24 is an elevated fragmentary cross-sectional view showing the mounting details for a single layer diaphragm member for use in the new and improved diaphragm metering pump of the invention;

FIG. 27 is an elevated cross-sectional view of a pump head and product head assembled together with a leak detection diaphragm assembly in accordance with a preferred embodiment;

FIG. 30 is an elevated fragmentary cross-sectional view of the preferred diaphragm member shown in FIG. 29;

FIG. 34 is a schematic diagram of an electronic alarm relay control circuit in accordance with a preferred embodiment;

FIG. 37 is a top plan view of the new and improved keypad and display module in the electronically controlled diaphragm metering pump in accordance with a preferred embodiment;

FIG. 39 is a top plan view of a new and improved electronically controlled diaphragm metering pump in accordance with a preferred embodiment;

FIG. 40 is a top plan view of a plug board for the digital logic controller in the electronically controlled diaphragm metering pump in accordance with a preferred embodiment.

DETAILED DESCRIPTION OF THE PREFERRED EMBODIMENTS

Figure 1:
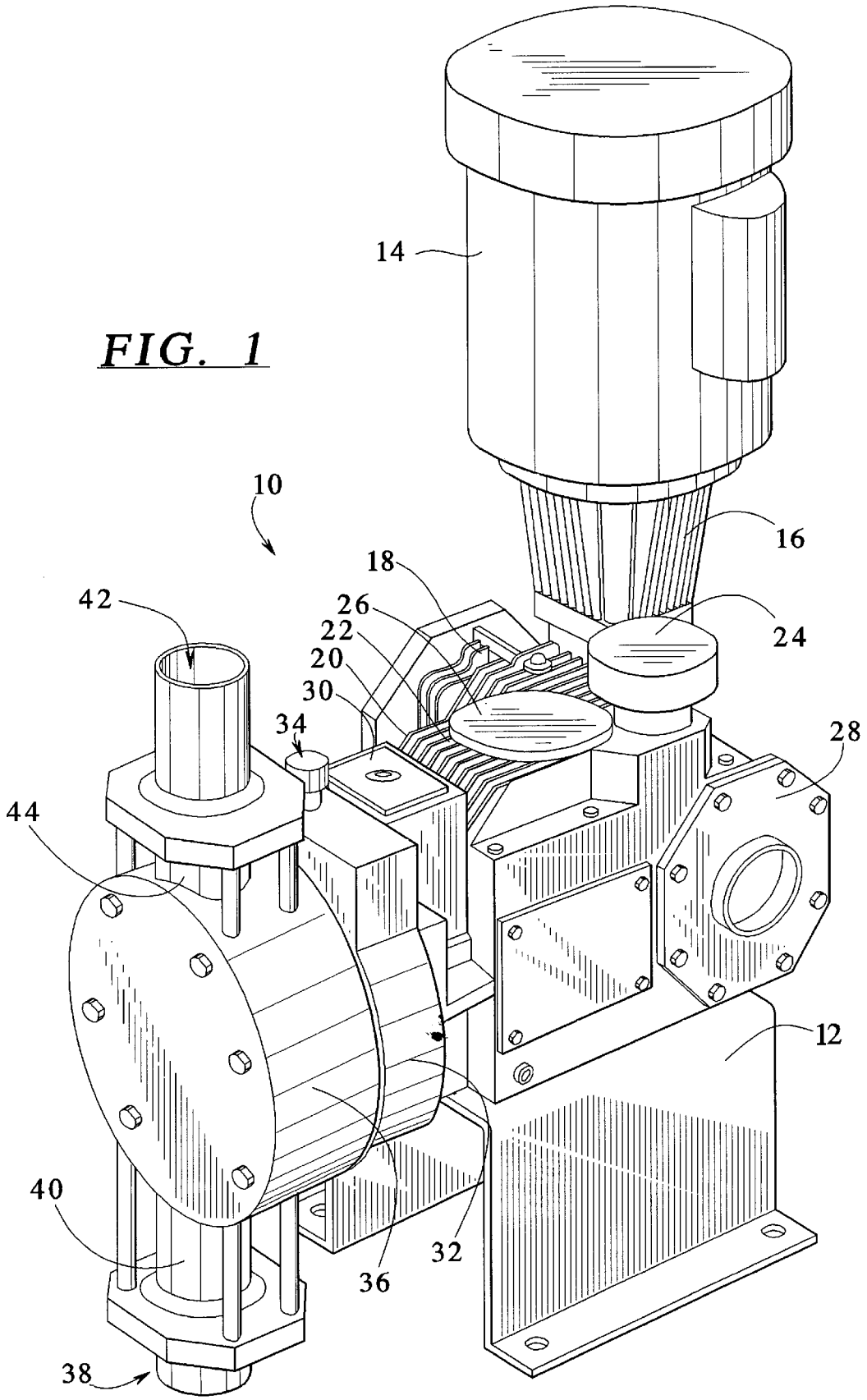
FIG. 1 is a perspective view of the new and improved diaphragm metering pump in accordance with a preferred embodiment of the present invention.

Referring now to FIGS. 1–3, the new and improved diaphragm metering pump in accordance with a first embodiment of the invention, generally referred to by reference numeral 10, is shown. In FIG. 1, pump 10 is shown in a fully assembled condition ready for use mounted on a mounting bracket 12. As depicted in FIGS. 1–3, pump 10 includes an electric motor 14 mounted on motor mount 16 which is in turn mounted on gear reducer housing 18. Gear reducer housing 18 is mounted to a side of the pump housing 20, adjacent a rear end portion thereof. The top portion of pump housing 20 is covered by a lid member 22. A spring-loaded, push to turn stroke length adjustment hand knob 24 projects from an upper surface of the lid 22. A dial 26 indicating the percentage of stroke length set by hand knob 24 is also disposed in the upper surface of lid 22 in the preferred embodiment depicted therein. An eccentric mounting aperture cover plate 28 is shown mounted on the side of pump housing 20, opposite gear reducer housing 18. Pump 10 also preferably includes a diagnostics window 30 disposed adjacent the upper front end of pump housing 20.

As shown in FIG. 1, a pump head 32 including a push to prime air bleeder valve 34 is mounted to the front end of pump housing 20. A product head 36 is mounted to the pump head 32. Product head 36 includes a product inlet 38 with an inlet check valve 40 and a product outlet 42 with an outlet check valve 44.

As shown in FIG. 3, new and improved pump 10 is provided with a modular construction. Motor 14, motor mount 16 and gear reducer housing 18 may be mounted for operation on either side of pump housing 20, as shown in phantom lines. In addition to alternate side mounting, these parts may be mounted to pump housing 20 in a large number of rotational positions to provide almost any pump configuration required to meet a customer's space requirements. The flexibility provided by the modular construction of pump 10 is a major advantage which will be more fully described hereinafter.

Figure 4:
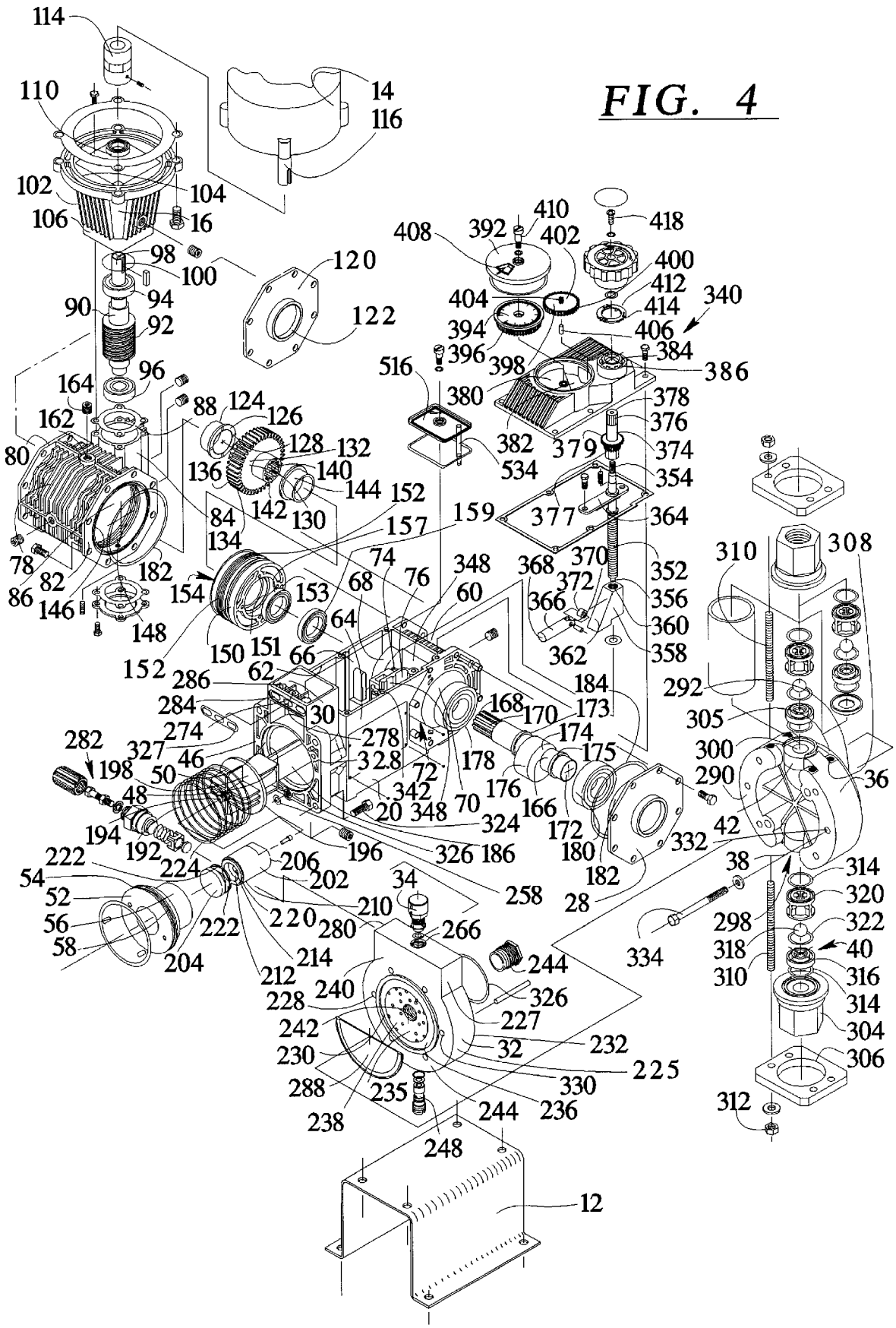
FIG. 4 is an exploded perspective view of the new and improved diaphragm metering pump of the invention in accordance with the preferred embodiment of FIG. 1.
Figure 5:
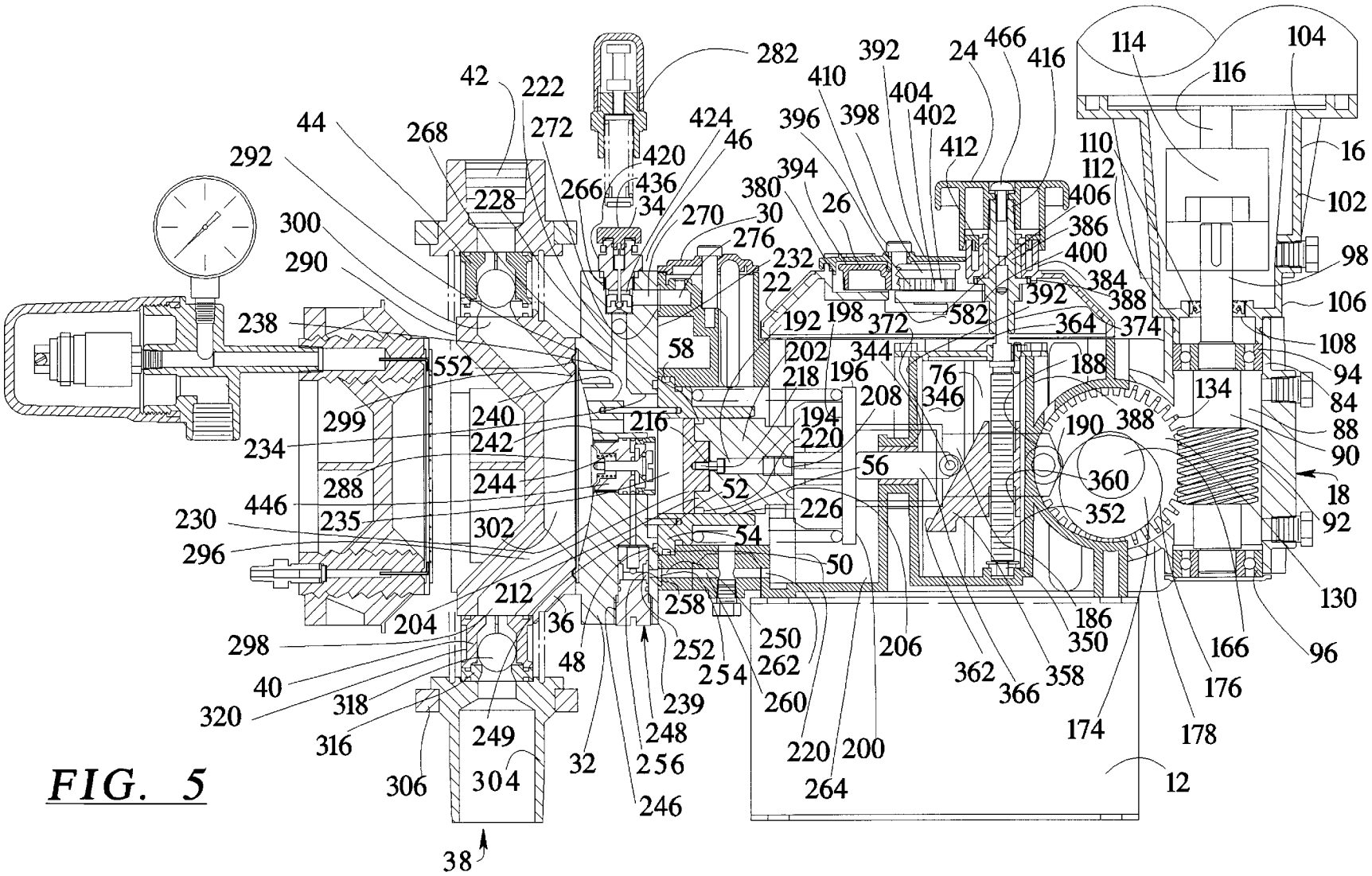
FIG. 5 is an elevated cross-sectional view of the new and improved diaphragm metering pump of this invention in accordance with the preferred embodiment of FIG. 1, shown with an alternative product head with a leak detection system.

In greater detail, and referring now to FIGS. 4–5, pump housing 20 includes a front end 46 with an opening 48 having a stepped shoulder 50 defined therein. A hollow cylinder member 52 having an outwardly stepped mounting portion 54 and a rearwardly extending cylindrical sleeve portion 56 is received in the front opening 48 so that the mounting portion 54 is firmly seated and sealingly engaged by means of captured O-ring 58 on step shoulder 50. Pump housing 20 further includes an opposed rear end 60 and a pair of parallel spaced apart sidewalls 62 and 64 extending between and connecting front end 46 and rear end 60. An open topped eccentric cavity 66 is defined in the interior portion of pump housing 20. A pair of aligned eccentric mounting apertures 68 and 70 are provided in sidewalls 62 and 64, respectively, adjacent rear end 60. Eccentric mounting apertures 68 and 70 are each provided with an outwardly facing mounting recess 72 having an octagonal configuration. Eccentric mounting apertures 68 and 70 communicate with eccentric cavity 66. In the preferred embodiment shown in FIGS. 4–5, pump housing 20 additionally includes a diagnostics window 30 as well as an upstanding partition wall 74 defining a vertical passageway 76 adapted to receive a stroke length adjustment assembly 340, both of which will be more particularly described below. Pump housing 20 is preferably made from a metal casting and a cast 380 aluminum alloy is preferred although other materials may also be used.

The gear reducer assembly is housed within gear reducer housing 18. Gear reducer housing 18 comprises a first hollow cylindrical portion 78 having octagonally shaped mounting faces 80 and 82 on the opposed ends thereof. A second vertically oriented hollow cylindrical projecting portion 84 projects from a side of cylindrical portion 78 intermediate the length thereof. The interior passageway 86 of horizontal portion 78 and the interior passageway 88 of vertical portion 84 intersect each other. A worm shaft 90 including a spiral threaded worm section 92 is rotatably mounted in vertical cylinder portion 84 with upper and lower roller bearings 94 and 96. An upper end 98 of worm shaft 80, including a flat 100, extends upwardly and outwardly from a top opening in vertical cylindrical portion 84. As is best shown in FIG. 5, motor mount 16 includes a cup-shaped body portion 102 having an enlarged top opening 104 and a bottom end 106 including a central opening 108 provided with a rotary shaft seal 110. An outwardly projecting cylindrical collar 112 is disposed radially outwardly from central opening 108 in bottom end 106. When motor mount 16 is mounted onto the upper end of vertical cylinder portion 84, the upper end 98 of worm shaft 80 passes through central opening 108 and shaft seal 110 within motor mount 16. The downwardly projecting collar 112 is telescopically received into top opening of vertical cylinder portion 84 and bears against upper roller bearing 94 to urge the worm shaft 90 and lower roller bearing 96 to a fully inserted and seated position within vertical cylinder portion 84. A motor damper coupling 114 may be provided to connect the upper end 98 of worm shaft 90 to a shaft 116 from motor 14.

The open end 118 on horizontal cylinder portion 78 is adapted to sealingly mount and receive a cover plate 120 having an octagonal configuration, similar to aperture cover plate 28. Cover plate 120 includes a centrally disposed outwardly projecting hollow cylindrical sleeve portion 122 adapted to telescopically receive a first cylindrical bearing 124 having a radial flange 126 at one end thereof. Radial flange 126 is provided with cross grooves 128 to permit lubricant entry to lube the bearing. A worm gear 130 is provided including an enlarged cylindrical gear portion 132 with outwardly projecting worm gear teeth 134 defined along a peripheral edge thereof. Worm gear 130 also has a pair of outward cylindrical hub projections 136 and 138 extending from opposed sides of portion 132 and defining an elongate hollow central hub 140. Inner surfaces of hub 140 are provided with inwardly projecting gear teeth 142. Hub projection 136 is adapted to be telescopically rotatably received in first cylindrical bearing 124. A second cylindrical bearing 144 similar to bearing 124 is telescopingly and rotatably received on hub projection 138.

Figure 36:
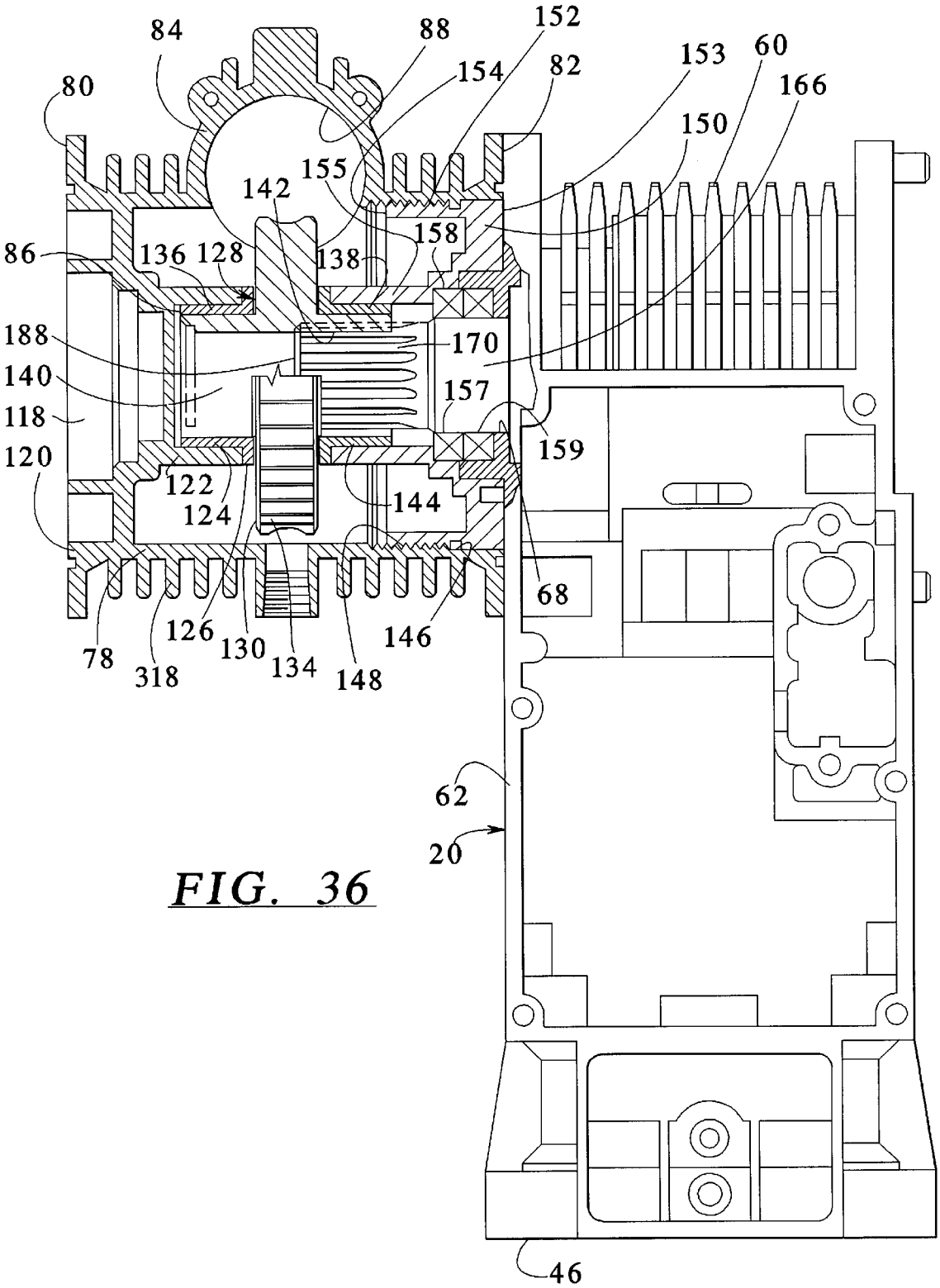
FIG. 36 is a fragmentary top plan view, partly in section, showing the mounting details for the assembled components within the gear reducer housing in accordance with the embodiment of FIG. 1.

As shown in FIGS. 4 and 36, the worm gear assembly including worm gear 130 and bearings 124 and 144 is inserted through the opposed open end 146 of horizontal cylindrical portion 78 until bearing 124 is received in sleeve portion 122 on cover plate 120. Open end 146 is provided with internal threads 148.

A cylindrical screw-on cap member 150 is provided with external threads 152. An inner end face 154 of cap member 150 is provided with a cylindrical sleeve projection 155 adapted to telescopingly receive an end of cylindrical bearing 144. An outer end face 153 of cap member 150 is provided with a stepped recess 151. Recess 151 cooperates with the outside of eccentric mounting aperture 68 to define a seal pocket for receiving a pair of radial lip seals 157, 159. As cap member 150 is inserted into open end 146 and rotated, external threads 152 engage internal threads 148 and the cap member 150 is advanced into open end 146 to firmly seat the bearings 124 and 144 into sleeve portion 122 on cover plate and to rotatably mount worm gear 130. In fully tightened position, the screw-on cap locks the rotatably mounted worm gear to prevent axial displacements thereof or end play along the hub axis.

Motor mount 16 and gear reducer housing 18 are also preferably cast from the same or different metal alloy as pump housing 20. Motor mount 16 and the vertical cylindrical portion 84 and horizontal cylindrical portion 78 of gear reducer housing are each preferably drilled and tapped at various places as indicated at 162 and 164 to permit the housings to be filled or drained with gear lubricant. A major advantage provided by the present invention is that the gear reducer assembly and the eccentric cavity are separated in different sealed modular housings which permits individual lubricants to be used in each location, rather than a mixed lubricant system. Accordingly, pump 10 may be provided with a food approved or edible oil hydraulic fluid and be approvable for use in food production settings. In addition, a plurality of interchangeable worm gears having different gear ratios may be provided and easily installed for rapid changeovers. Changeovers and maintenance of the gear reducer assembly may also be performed independently from the eccentric cavity in the pump housing 20.

The drive system for the new and improved pump 10 shown in FIGS. 4–5 further includes an elongate eccentric shaft 166. Eccentric shaft 166 includes first end 168 provided with a spline portion 170 and an opposed second end 172. An eccentric solid 174 is defined on shaft 166 having a peripheral cam surface 176 intermediate the first end 168 and second end 172. A pair of raised shoulders 174 and 176 may be provided to positively position roller bearings 178 and 180 on the shaft 166. In accordance with the present invention, the separation distance between roller bearings 178 and 180 is desirably small which reduces shaft deflection stresses on shaft 166 improving durability of the drive system. The first end 168 of eccentric shaft 166 is inserted through the eccentric mounting aperture 68 in sidewall 62 of pump housing 20, through radial lip seals 157, 159 and the central sealed opening of the screw-on cap member 150 and bearing 144 until the spline portion 170 is fully inserted in hub projection 138 and engaged with the hub teeth 142. The octagonal mounting face 80 of gear reducer housing 18 may then be sealingly mounted by means of the face seal 182 into eccentric mounting aperture 68. Any suitable mounting hardware such as threaded bolts may be used.

In this partially mounted position, the eccentric solid 174 is disposed in eccentric cavity 66 and second end 172 is disposed in the opposite eccentric mounting aperture 70. Roller bearing 180 may be telescopically inserted on the second end of shaft 166. Thereafter, the eccentric mounting aperture cover plate 28 including an inwardly projecting cylindrical sleeve 182 may be sealingly mounted over eccentric mounting aperture 70 and sealed by face seal 184 so that roller bearing 180 is telescopically received within sleeve 182.

In accordance with a preferred embodiment, eccentric shaft 166 is a one-piece forged steel shaft. Different eccentric shafts having different eccentric offsets to provide differing stroke lengths may be provided.

Pump 10 further includes a piston and crosshead rod actuator assembly for translating rotational motion of the eccentric shaft 66 into reciprocal linear motion of the piston for displacing the diaphragm. More particularly, in accordance with the preferred embodiment depicted in FIGS. 4–5, an elongate crosshead rod 186 is provided including a rearward end 188 equipped with a cam follower roller 190, shown in FIG. 5. Crosshead rod 186 includes an opposed forward end 192 with an externally threaded projection 194. A radial flange 196 is disposed adjacent the forward end 192. Radial flange 196 includes a forwardly facing bearing surface 198 and a rearwardly facing surface 200. In the preferred embodiment shown in FIGS. 4–5, the piston is a two-piece member including a body portion 202 and a front end portion 204. Body portion 202 has a generally cylindrical configuration including a rear end 206 with an internally threaded aperture 208 and a front end 210 with a counterbored recess 212 having internally threaded aperture 214. Front end portion 204 has a stepped cylindrical configuration, a portion of which is adapted to be received in recess 212. A mounting through-hole aperture 216 is provided in front end portion 204 so that a threaded bolt 218 may be passed through front end portion 204 and threadedly engaged in the internally threaded aperture 214 on body portion 202. A peripheral inwardly stepped shoulder 220 is defined in front end 210 to receive piston seal 222 as shown, such as U-shaped spring energized piston seal, trapped between the front piston portion 204 and shoulder 220. The assembled piston is connected to the front end 192 of the crosshead rod 186 by threaded engagement of the threads provided in rear aperture 208 onto threaded projection 194. Other piston styles may also be used.

The assembled piston and crosshead rod are positioned in pump housing 20, so that cam follower roller 190 and rear end 188 of crosshead rod 186 are received through the front end opening 48 of pump housing 20. A biasing member such as coil spring 224 is placed over the forward end 192 of the crosshead rod 186 so that the piston including body portion 202 and front portion 204 is telescopically received therein. Piston body portion 202 and front portion 204 are slidably, sealingly and telescopically received in a rear end opening 226 in cylindrical sleeve portion 56 of cylinder member 52. Coil spring 224 is thereby disposed between a rearward facing surface of the front mounting portion 54 on cylinder member 52 and the forwardly facing surface 198 on radial flange 196. In the installed position of the piston 202, 204 and cylinder 52 in the front end opening 48 of the pump housing, the cam follower roller 190 on the rear end 188 of crosshead rod 186 is positioned to engage the cam surface 176 on the eccentric solid 174 on rotation of eccentric shaft 166. The cam follower roller 190, biased rearwardly by coil spring 224 may be positioned so that it rides on the entire cam surface 176 through one complete revolution of the eccentric shaft 166. Preferably, however, pump 10 is a loss motion pump which provides that in a fully rearwardly retracted position of the crosshead rod 186, the cam follower roller 190 is disposed adjacent the cam surface 176 and only engages the high points on cam surface 176 during rotation of the eccentric shaft 166.

As shown in FIGS. 4–5, pump 10 further includes a new and improved pump head 32. Pump head 32 has an inverted keyhole shaped configuration including a generally cylindrical lower portion 224 and a projecting rectangular upper portion 226. Pump head 32 includes a front end 228 with an opening 230 and an opposed rear end 232 with an opening 234. A hydraulic chamber 235 is defined therein extending from front opening 230 to rear opening 234. Front opening 230 includes a stepped peripheral diaphragm mounting shoulder 236. An inwardly directed concave contour plate 238 is provided in pump head 32 adjacent front opening 230. Contour plate 238 contains a plurality of flow-through perforations 240 as well as a centrally disposed threaded aperture 242 adapted to mountingly receive a hydraulic refill cartridge valve assembly 244.

A bottom end of pump head lower portion 224 includes a threaded orifice 246 adapted to threadedly receive a screwed ball check valve 248. Valve 248 is provided to prevent back flow. As shown in FIG. 5, pump head 32 is provided with a vertical channel 248 extending between the central aperture 242 on contour plate 238 and bottom orifice 246. Pump head 32 also includes a short horizontal channel 250 defined between bottom orifice 246 and a lower opening 252 defined in rear end 232. The lower opening 252 is aligned with a corresponding lower opening 254 having a peripheral recess 256 for receiving an O-ring 258 defined in the front end 46 of pump housing 20. A hydraulic fluid refill supply channel 260 is provided in the lower end of pump housing 20 which extends from lower opening 254 to a rear end opening 262 communicating with a hydraulic fluid reservoir 264 provided in pump housing 20.

Again as shown in FIGS. 4–5, pump head 32 includes a top threaded orifice 266 which is adapted to threadedly receive a push to prime air bleeder valve assembly 34. As shown in FIG. 5, a vertical channel 268 extends between hydraulic chamber 235 and top orifice 266. An exit channel 270 extends between top orifice 266 and an exit opening 272 disposed in the upper end of pump head rear end 232. Exit opening 272 is aligned with a central front orifice 274 defined in the upper portion of pump housing front end 46. Central orifice 274 communicates with an L-shaped channel 276 having an exit port 278 disposed adjacent diagnostics window 30.

Pump head 32 further includes another threaded orifice, not shown but indicated in FIGS. 4 and 5, defined in a side surface 280 of upper portion 226 of pump head 32. This side orifice is adapted to receive a conventional manually adjustable spring-loaded pressure relief valve assembly 282. The side orifice includes a side opening communicating with a channel having an exit opening disposed in rear end 232 adjacent exit opening 272. This exit opening is aligned with another orifice 284 adjacent central orifice 274. Orifice 284 is also connected to an L-shaped channel similar to 276 which also ends in the exit port 286 disposed adjacent diagnostics window 30.

Pump 10 additionally comprises a diaphragm or diaphragm assembly 288 and a product head 36. Product head 36 includes a lower product inlet 38 and an upper product outlet 42. In greater detail and referring again to FIGS. 4 and 5, product head 36 includes a front end 290 and an opposed rear end 292 with an opening 294. A fluid flow passageway 296 extends through the product head from an entrance opening 298 at inlet 38 to an exit opening 300 at outlet 42. An intermediate portion of passageway 296 intersects with rear opening 294 to define a product chamber 302. A one-way inlet check valve 40 is disposed over entrance opening 298. A pipe or tubing connector 304 covers the inlet check valve 40 and has a threaded inner aperture adapted to receive a threaded coupling on the end of a pipe or tubing (not shown) whose other end is disposed in fluid communication with a product supply, such as a product container. The connector 304 and check valve 40 are securably mounted to the entrance opening 298 by means of a four-bolt tie down 306. Threaded mounting apertures 308 are provided in the upper and lower ends of product head 36 and threadedly receive mounting bolts 310. Tie down 306 is tightened by means of nuts 312 to sealingly compress the O-rings 314 between the entrance opening 298 and inlet check valve 40 and between check valve 40 and connector 304, as well as the valve components of the inlet check valve 40. Inlet check valve 40 includes a valve seat 316, a ball check 318, a four-vaned fluted valve guide 320 and O-ring 322. Fluted valve guide 320 helps to assure rapid and accurate repositioning of the ball check 318 on valve seat 316. The structures provided at the product outlet 42 of product head 36 are substantially the same as for the product inlet 38 as shown in FIGS. 4–5.

To assemble the front end of pump 10 for use, the pump head 32 is sealingly mounted to the front end of pump housing 20 by means of threaded bolts 324 which pass through mounting apertures 326 provided in a mounting face 328 defined in pump housing front end 46. Bolts 324 are threadedly engaged in threaded mounting apertures (not shown) provided in pump head rear end 232. As bolts 324 are tightened, the rear end 232 of pump head 32 engages the front end 46 of pump housing 20. Further tightening is effective to compress the various seals disposed therebetween including O-ring 258, face seal 326, and three-ported face seal 328. It is also effective to fully seat and seal cylinder member 52 and its O-ring 58 in the front end opening 48 of pump housing 20.

With diaphragm assembly 288 positioned in an annular diaphragm mounting recess 552 provided in product head rear end 292, the product head 36 may be sealingly mounted onto the front end 228 on pump head 32. A plurality of threaded mounting apertures 320 are provided in front end 228 disposed peripherally about front end opening 230. A plurality of aligned pass through mounting apertures 332 extend through product head 36. Threaded mounting bolts 334 extend through apertures 332 and into threaded apertures 330 to securely mount the product head 36 to the pump head 32. In fully mounted position, diaphragm assembly 288 is sealingly engaged between the rear end opening 294 of product head 36 and front end opening 230 in pump head 32. Diaphragm 288 effectively covers each of these openings 294 and 230 and forms a resilient flexible partition separating the product chamber 302 and hydraulic chamber 235.

In operation of pump 10, motor 14 turns worm shaft 90 which rotates worm gear 130. Worm gear 130 turns eccentric shaft 166. Rotation of eccentric shaft 166 rotates eccentric solid 174 so that the cam surface 176 engages cam follower roller 190. Further rotation of the eccentric solid 174 pushes the crosshead rod 186 against coil spring advancing the piston assembly 202, 204 forwardly within cylinder member 52. Further rotation of the eccentric solid 174 gradually permits the crosshead rod 186 to move rearwardly again under the action of coil spring 224, which rearwardly retracts the piston assembly 202, 204 within cylinder member 52. Hydraulic fluid present in hydraulic chamber 235 moves forwardly and rearwardly with the piston assembly 202, 204 to provide pumping displacements to the diaphragm 288.

Figure 6:
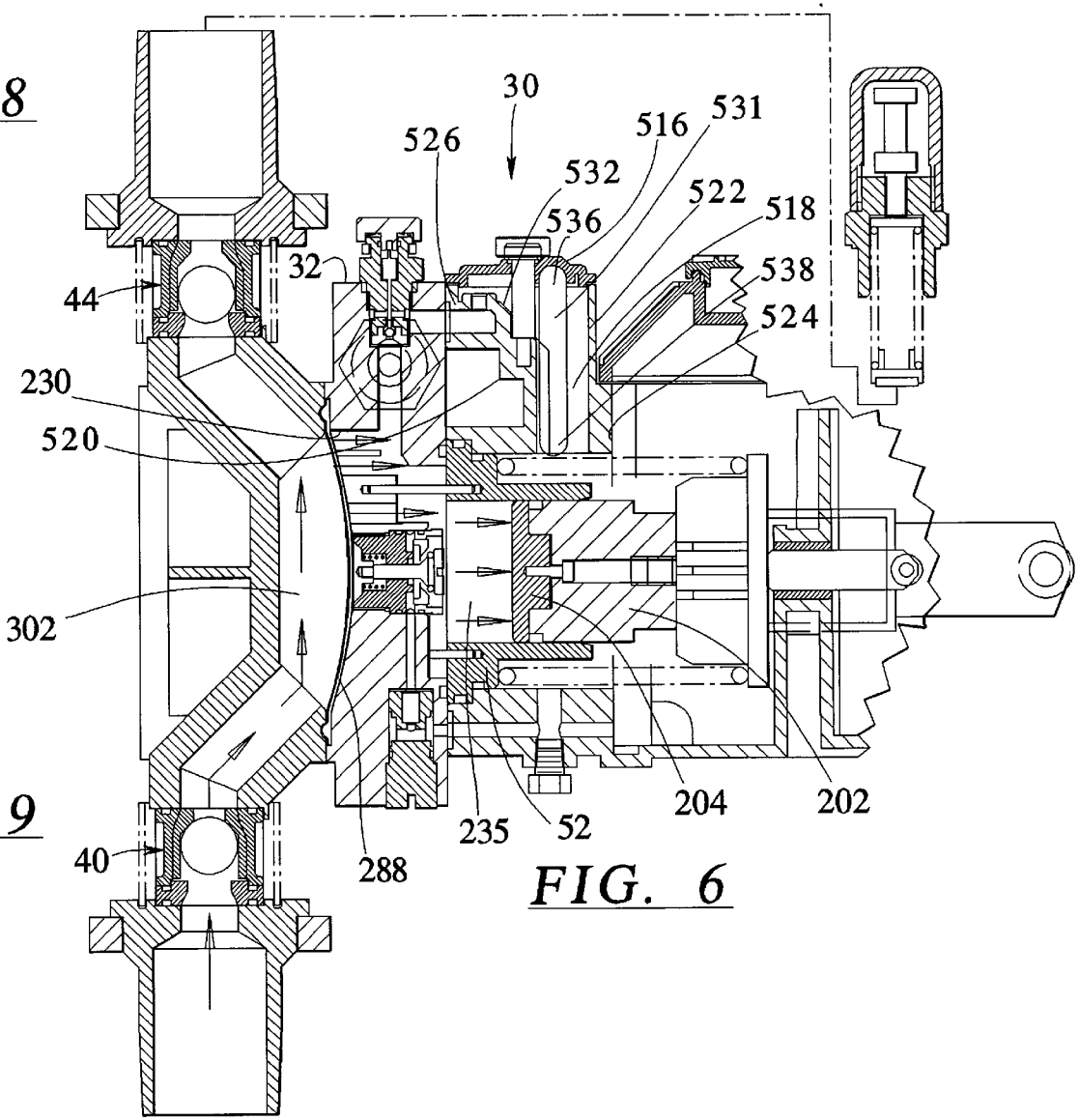
FIG. 6 is a fragmentary elevated cross-sectional view of the front end portion of the new and improved diaphragm metering pump of the invention in accordance with the embodiment of FIG. 1, showing the pump in its suction position.

Referring now to FIGS. 6 and 7, the suction and discharge modes of diaphragm pump 10 are shown, respectively. As shown in FIG. 7, as piston assembly 202, 204 is retracted rearwardly within cylinder member 52, the pressure of the hydraulic fluid in the hydraulic chamber 235 is reduced, displacing the diaphragm 288 into the front opening 230 of pump head 32. The inward displacement of diaphragm 288 reduces the pressure on the product fluid in the product chamber 302 which closes the outlet check valve 44. The inlet check valve 40 is opened and further inward displacement of the diaphragm 288 sucks product fluid through the inlet check valve 40 into product chamber 302.

Figure 8:
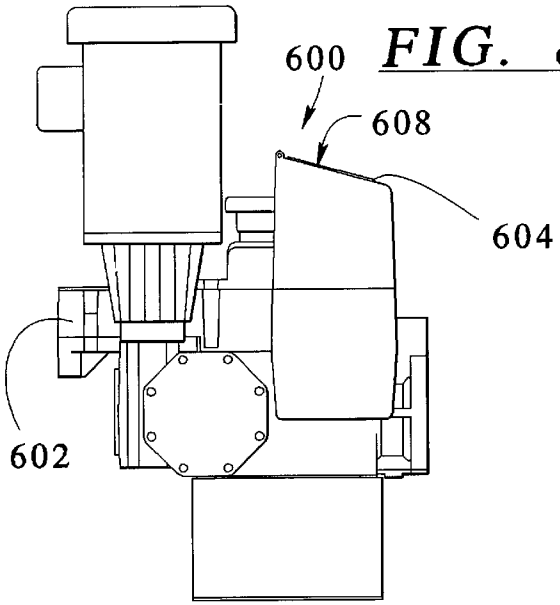
FIG. 8 is a side elevation view of the new and improved diaphragm metering pump in accordance with a second embodiment having an electronic control system shown with the pump head and product head portions removed.
Figure 9:
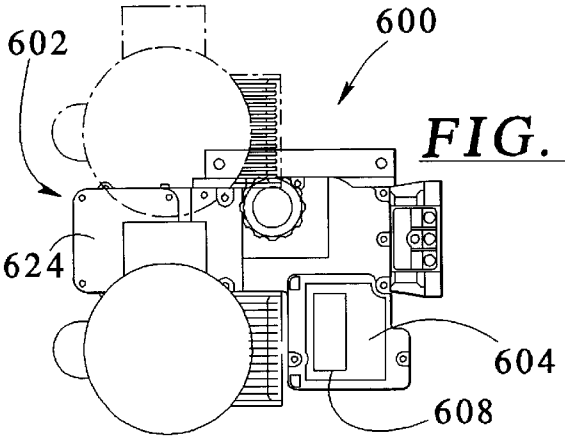
FIG. 9 is a top plan view of the new and improved diaphragm metering pump shown in FIG. 8.
Figure 10:
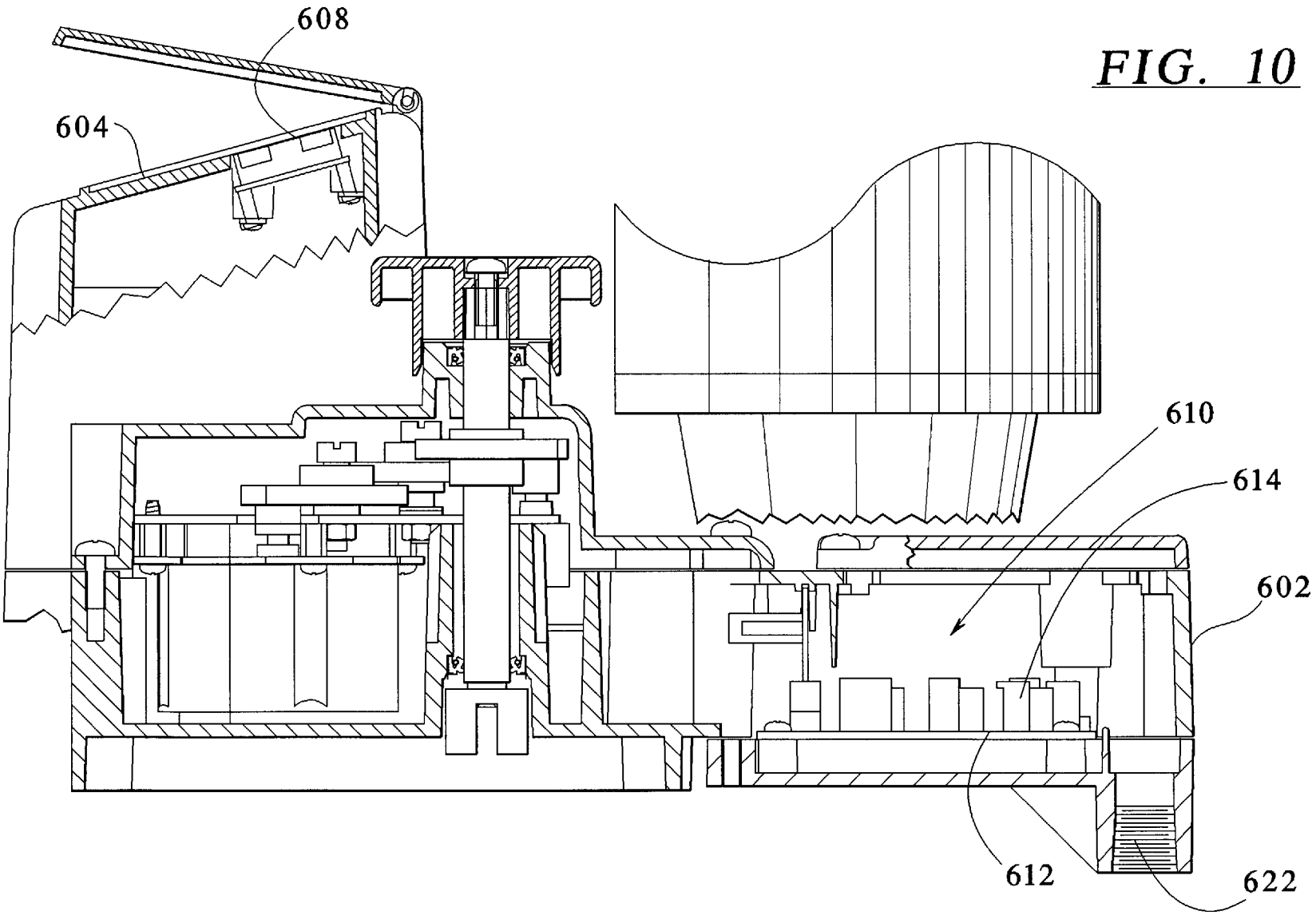
FIG. 10 is an elevated cross-sectional view of the new and improved diaphragm metering pump of FIG. 8, also shown with an optional product head equipped with a diaphragm leak detection system.

As the piston assembly 202, 204 moves forwardly from its retracted to the extended position shown in FIG. 8, fluid pressure in hydraulic chamber 237 increases displacing the diaphragm 288 forwardly into product chamber 302. Fluid pressure in product chamber 302 increases as a result which is effective to close inlet check valve 40 and open outlet check valve 44. Further forward displacement of diaphragm 288 into product chamber 302 forces product fluid in product chamber 302 out through the outlet check valve 44.

The new and improved diaphragm metering pump 10 is provided with a number of preferred features and systems including modularity, a stroke length adjustment assembly 340, a diagnostics window 30, a push to prime air bleeder valve 34, a hydraulic refill cartridge valve 244 and a variety of diaphragm assembly options 288, 540, 542, 544.

With regard to modularity, the drive system of pump 10 is made up of symmetrical and modular elements which permit the motor 14, motor mount 16 and gear reducer housing 18 to be mounted in either of eccentric mounting apertures 68 and 70. The octagonal mounting recess 72 around mounting apertures 68 and 70 and octagonal mounting faces 80 and 82 on gear reducer housing 18 permit the gear reducer housing 18 to be mounted to pump housing 20 in a plurality of incremental 45° rotational orientations as shown in FIGS. 11(*a*)–11(*d*). Accordingly, the assembled structure of pump 10 may take on a number of configurations to accommodate any space restrictions which may be presented at a given location.

Referring once again to FIGS. 4–5, pump 10 is preferably provided with a stroke length adjustment assembly, generally referred to by reference numeral 340. Stroke length adjustment assembly 340 is adapted to be telescopically received and mounted in vertical passageway 76 defined between partition wall 74 and sidewall 64 of pump housing 20. Partition wall 74 includes a front panel portion 342 having a cylindrical mounting sleeve 344 defined therein as shown in FIG. 5. Partition wall 74 additionally includes a side panel portion 346 and a rear panel portion 348. A rotational footing 350 is disposed in the bottom of vertical passageway 76.

Stroke length adjustment assembly 340 includes a threaded shaft member 352 having a splined upper end 354 and an opposed lower end 356. A cam solid 358 having a threaded aperture 360 therethrough is adapted to be threadedly engaged on shaft member 352 and to ride upwardly and downwardly in vertical passageway 76 upon rotation of shaft member 352 in alternate directions. An angled cam surface 362 is provided on the front of cam member 358. A mounting bracket 364 is provided for rotatably mounting shaft 352 in vertical passageway 76. An actuator rod 366 is slidably mounted in mounting sleeve 344. Actuator rod 366 has a front end 368 adapted to abut rearward facing surface 200 on crosshead radial flange 196 and an opposed rear end 370 having a cam follower roller 372 adapted to engage and ride on angled cam surface 362. As shown in FIGS. 4–5, rotating shaft member 352 so as to lift cam solid 358 within passageway 76 pushes actuator rod forwardly against flange 196 which is effective to compress coil spring 224. The front end 368 acts as a positive stop to limit rearward travel of the crosshead rod and piston assembly. As actuator rod 366 is moved forwardly, the retracted position of the piston is moved toward the diaphragm so that the stroke length defined between the extended and retracted positions is shortened. Shorter stroke lengths decrease the rate of flow of product fluid through the product head. Accordingly, the stroke length adjustment assembly provides a method for adjusting the flow rate, usually downwardly, for a given gear ratio and motor speed setting.

In accordance with the preferred embodiment shown in FIGS. 4–5, stroke length assembly 340 is provided with a manual means for supplying rotation to the shaft 352. As depicted therein, manual control of stroke length adjustment is provided by a telescoping spring-loaded shaft extender 374 having a lower end with a toothed aperture adapted to be telescopingly received on and engaged with the splined end 354 of shaft 352. An upper end of shaft extender 374 has a splined portion 376 and a screw receiving aperture 378. An intermediate flange 377 is provided as well as a geared flange 379 on shaft extender 374.

In accordance with the preferred embodiment shown in FIGS. 4–5, the lid member 22 covering eccentric cavity 66 is provided with an upper cylindrical dial receiving recess 380, a lower gear wheel receiving recess 382 and a handle mounting projection 384. Handle mounting projection 384 includes a central aperture 386 and an internally geared recess 388 in the underside thereof adapted to capture geared flange 379. Stroke length adjustment assembly 340 also includes a dial cover 392, a dial 394 with depending peripheral gear teeth 396, a gear wheel 398 with gear teeth 400 around the peripheral edge and a hub projection 402 also provided with gear teeth 404. Gear wheel 398 is rotatably mounted in gear wheel recess 382 by a mounting pin 406. Dial 394 is rotatably mounted in recess 382 and the telescoping dial cover with window 408 is secured thereon with mounting screw 410. In mounted position, the edge teeth on gear wheel 398 may be engaged with the teeth on geared flange 379 when knob is pushed downwardly moving geared flange 379 out of locked engagement in geared recess 388 in lid 22. The hub teeth 404 on hub 402 are engaged with depending dial teeth 396, so that after pushing downwardly, rotation of the shaft extender 374 turns gear wheel 398 which rotates dial 394.

The upper splined end 376 of shaft extender 374 is telescopically, rotatably received through lid 22 and the central aperture 386 of handle mount projection 384. A spring member 412 with dependent angled tangs 414 is placed over the upper end of shaft extender 374. A handle knob 24 having a central toothed aperture 416 in an underside surface thereof is telescopingly received over splined portion 376 and the assembly is tightened and secured together by threaded mounting screw. Spring washer 412 biases geared flange 379 upwardly in locked position in geared recess 388 to prevent unintended rotation of shaft extender 374 and shaft 352 due to vibration or the like. This positive rotation lock can be overcome by pushing down on knob 24 to free geared flange 379 from recess 388 so that, upon turning the knob 24, shaft extender 374 and shaft 352 are rotated as well as dial 394 until the knob is released relocking the shafts, knob and dial.

Figures 19, 20, 21, 22:
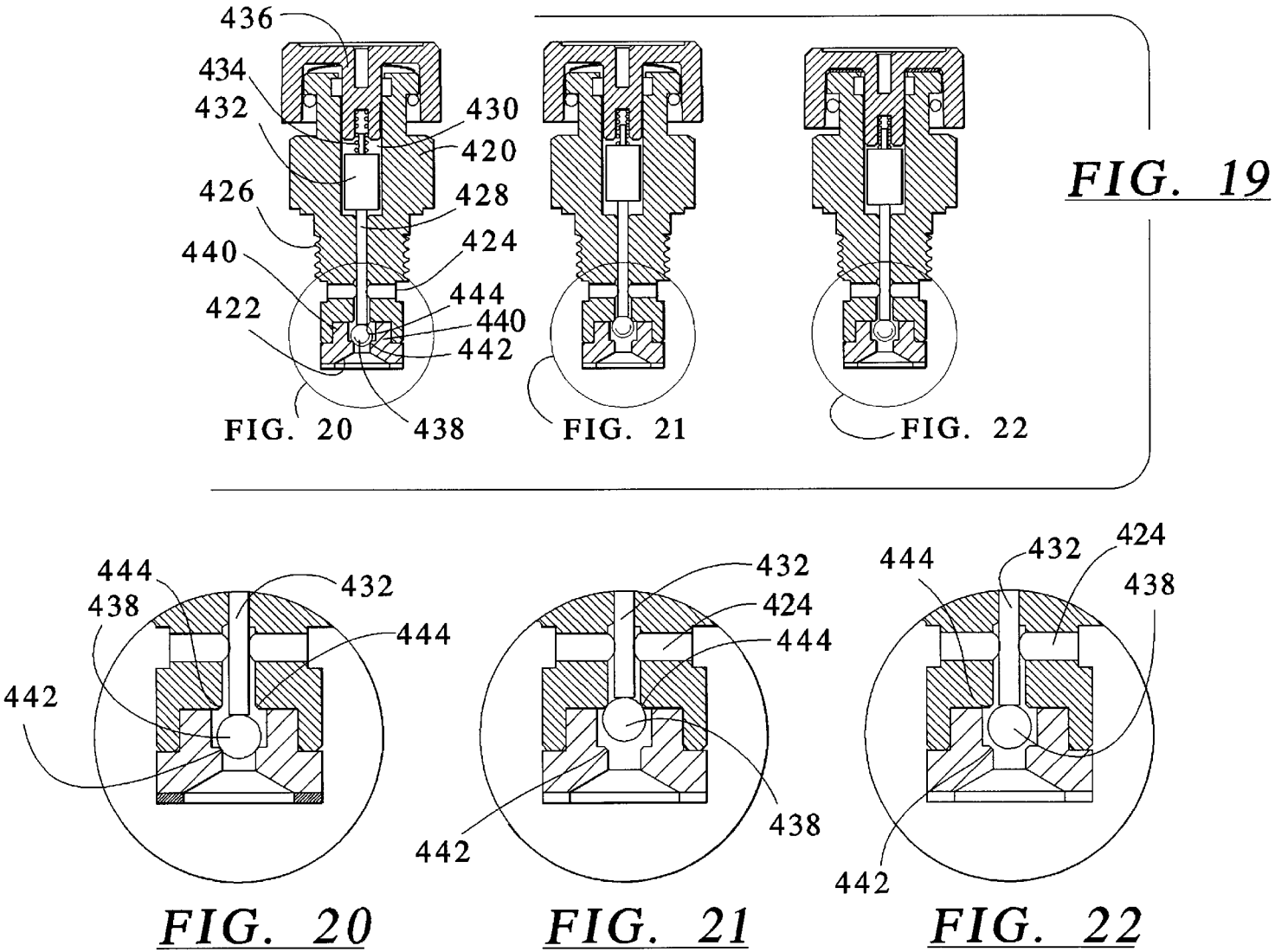
FIG. 19 is an elevated cross-sectional view of the new and improved push to prime air bleeder valve assembly in accordance with a preferred embodiment.
FIG. 20 is an enlarged fragmentary cross-sectional view of the push to prime air bleeder valve assembly shown in its closed position which occurs when the pump is in a suction mode.
FIG. 21 is an enlarged fragmentary cross-sectional view of the push to prime air bleeder valve assembly shown in the second closed position which occurs when the pump is in the discharge mode.
FIG. 22 is an enlarged fragmentary cross-sectional view of the push to prime air bleeder valve assembly shown in an open priming condition.
Figure 25:
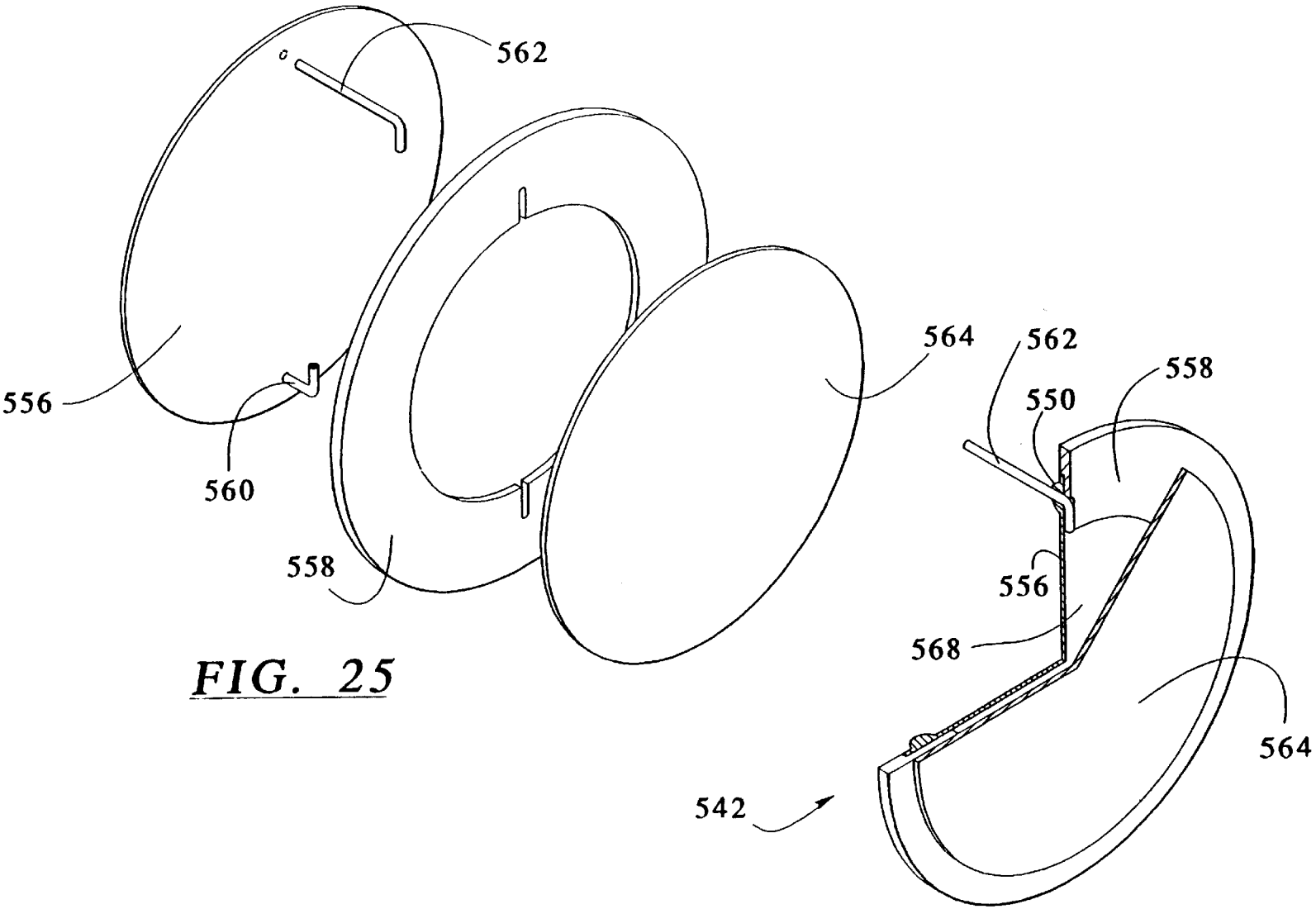
FIG. 25 is an exploded perspective view of a leak detection diaphragm assembly in accordance with a preferred embodiment.

Another preferred feature of pump 10 is the push to prime air bleeder valve assembly 34. Details of the construction and operation of the push to prime air bleeder valve 34 are shown in FIGS. 19–22. More particularly, as shown in FIG. 19, valve 34 includes a valve housing 420 including a front end opening 422, a side exit housing 424, a threaded mounting portion 426, a core aperture 428, an enlarged upper bore 430, a weighted valving pin 432, an optional biasing member, such as coil spring 434, a push button top 436, and a ball check 438. A shuttle ball check valving chamber 440 including a lower seat 442 and a spaced upper seat 444 is disposed between front end opening 422 and side exit opening 424.

The normal operating mode of the push to prime air bleeder valve 34 is shown in FIGS. 20–21. In normal operating mode, valve 34 acts like a conventional air bleeder valve. On the suction stroke of the piston, shown in FIG. 20, the ball check 438 seats on lower seat 442 closing the valve. On the discharge stroke, shown in FIG. 21, the ball check 438 shuttles upwardly until it seats against the upper seat 444, again closing the valve 34. As the ball check 438 moves from the lower seat 442 to the upper seat 444, the valve 34 is temporarily opened allowing a small amount of fluid or air to be removed from the hydraulic chamber 235 with each stroke of the piston. Air and fluid exiting valve 34 through exit opening 424 flows into the center orifice 274 and out center exit port 278 in the diagnostics window 30.

In push to prime operating mode, the push top 436 is pressed downwardly. In this position, the end of valving pin 432 does not move fully upward and maintains the ball check 438 off of the upper seat 444, keeping the valve open as shown in FIG. 22. In this mode, on each forward discharge stroke of the pump, large amounts of air or hydraulic fluid are expelled through valve 34 unchecked. On the rearward suction stroke, the ball check 438 seats on lower seat 442 as new hydraulic fluid is drawn into the hydraulic chamber through hydraulic refill cartridge valve assembly 244. The new and improved push to prime feature permits the hydraulic system to be primed any time the pump is running without requiring removal of any parts. As the pump runs, the push to prime mode can be maintained, until a stream of fluid, free of air bubbles, is observed exiting the center exit port 278 in the diagnostics window 30. The biasing member 434 is optional and may be used for high suction conditions.

The new and improved hydraulic refill cartridge valve assembly 244 for use in pump 10 is shown in detail in FIGS. 5 and 13–18. More particularly, the hydraulic refill valve assembly 244 includes a valve housing cartridge 446, shown in FIG. 13, including a front end 448 having an external threaded portion 450 and a flared entrance opening 452 communicating with a spring receiving recess 454. An opposed rear end 456 of cartridge housing 446 includes a large rear end opening 458 with a first narrower seat receiving recess 460 and a second even smaller seal receiving recess 462. Cartridge housing 446 further has a middle portion 464 defined between the threaded portion 450 of front end 448 and rear end 456. A pair of spaced apart O-ring grooves 466, 468 receiving a pair of O-rings 470, 472 are provided on an outer surface of the middle portion 464. A peripheral hydraulic fluid channel 474 extends inwardly from the outer surface of the middle portion 464 between O-rings 470, 472 to an inner annular valve entrance opening 476 communicating with seat receiving recess 460. Cartridge housing 446 further includes a central passage 478 extending between spring receiving recess 454 and seal recess 462.

Hydraulic refill valve 244 further includes a poppet actuator 478, a shaft seal 480 and a valve seat 482, shown in FIGS. 14, 15 and 16, respectively. As shown in FIG. 14, poppet actuator 478 includes an elongate cylindrical valve stem 484 having a threaded front end 486, a frustoconical transition section 488 with a groove 487 and O-ring 489, and a larger diameter rear end 490. A poppet member 492 including a forward diaphragm engaging surface 494 and a rearward smaller diameter mounting portion 496 with a threaded aperture 498 threadedly engaged on the front end 486 of valve stem 484.

As shown in FIG. 15, hydraulic refill valve 224 includes new and improved shaft seal 480 providing improved non-weeping performance. Shaft seal 480 includes a cylindrical base portion 500 with a central stem receiving opening 502 and a 45° flared cup portion 504 defining a tapering rear end opening 506 communicating with stem receiving opening 502.

The valve seat 482, shown in FIG. 16, includes a cylindrical body portion 508 with a large diameter front end opening 510 and an inwardly tapering rear end opening 512.

Hydraulic refill cartridge valve 244 is assembled by positioning coil spring 514 in spring receiving recess 454, press-fitting shaft seal 480 into the seal recess 462 and the valve seat 482 into seat receiving recess. The forward end of valve stem 484 is inserted through rear end opening 458, valve seat 482, shaft seal 480, central passage 478 and spring recess 454 until the front threaded portion 486 extends from flared entrance opening 452. Thereafter, poppet member 492 is screwed onto threaded portion 450 of valve stem 484. In assembled condition, the valve is maintained in a normally closed position wherein O-ring 489 is sealingly engaged in rear opening 512 of valve seat 482 and the conical surfaces of the beginning of transition section 488 are sealingly engaged in the rear opening 506 of cup portion 504. The valve is open in use when the diaphragm pushes against front surface 494 of poppet member 492, moving valve stem 484 rearwardly by compressing the coil spring 514. Rearward movement of valve stem 484 spaces the transition section 488 away from shaft seal 480 and valve seat 482, thereby opening a continuous channel for flow of hydraulic fluid from annular valve opening 476 through valve seat 482 and out the rear end opening 458 of valve housing 446 into the hydraulic chamber 235.

The easy installation of hydraulic refill valve 244 in the central threaded aperture 242 in the contour plate 238 is shown in FIGS. 17–18. As shown in FIG. 17, the front end 448 of the assembled refill valve 244 is introduced into the central aperture 242 from the rear until the external threaded portion 450 engages the internal threaded portion of aperture 242. The valve 244 is rotated to advance the valve housing 446 to the fully seated and installed position as shown in FIG. 18. When fully installed, the annular valve opening 476 is disposed in sealed alignment with the upper opening of vertical channel 248 which is fluidly connected to the hydraulic fluid reservoir 264. An advantage provided in accordance with the invention is that product head and pump head may be removed as a unit from the front end of the pump housing to provide access to the hydraulic refill valve 244. Access is, therefore, provided without disassembling a large number of sealed connections of the pump.

The diagnostics window 30 provided in pump 10 is another preferred feature in accordance with this invention. In accordance with the preferred embodiment shown in FIGS. 4–5 and 23, diagnostics window 30 is provided in the top of pump housing 20 adjacent front end 46. Diagnostics window 30 includes a see-through cover member 516 which covers a well area 518 bounded by a double-stepped front wall 520 and a spaced rear wall 522. The lower end 524 of well area 518 is open and communicates with hydraulic fluid reservoir 264 in eccentric cavity 66. Stepped front wall 520 includes a first horizontal surface 526 including three spaced apart exit ports 286, 278 and 528. Exit port 286 communicates through an L-shaped channel to an orifice 284 in front end 46 and receives a flow of fluid exiting through pressure relief valve 282. Center exit port 278 communicates through L-shaped channel 276 to central front orifice 274 and receives air and fluid exiting from push to prime air bleeder valve 34. Exit port 528 is currently unassigned, but it also communicates through an L-shaped channel to a front orifice 530 in front end 46. A sloped surface 532 extends between horizontal surface 526 and a second horizontal surface 534. Second horizontal surface 534 includes a threaded mounting aperture 536 for receiving the end of mounting screw 538 to secure cover 516 in place. Sloped surface 532 is provided to reveal whether or not a continuous flow of fluid is exiting and spilling over from exit ports 286, 278 and 528. A continuous flow as opposed to a discrete intermittent flow from exit port 286, for example, would provide an indication that hydraulic refill valve 244 may be stuck in an open position, thereby providing an indication of the operating condition of the valve. The presence of air bubbles at exit port 278 indicates air is present in the hydraulic chamber 235 so that a push to prime purging operation should be performed. Finally, an optical tube 534 having a domed lens 536 in an upper end thereof is mounted in cover 516. The opposed lower end 538 of the optical tube 534 extends into the open lower end 524 of well 518 to be submerged in hydraulic fluid present in hydraulic reservoir 264. If the lower end 538 contacts colored hydraulic fluid, a colored dot appears in the domed lens 536 indicating a sufficient amount of hydraulic fluid in reservoir 264. If the lower end 538 does not contact fluid, the domed lens 536 shows up clear and not colored, indicating that additional hydraulic fluid should be added to reservoir 264.

Figure 28:
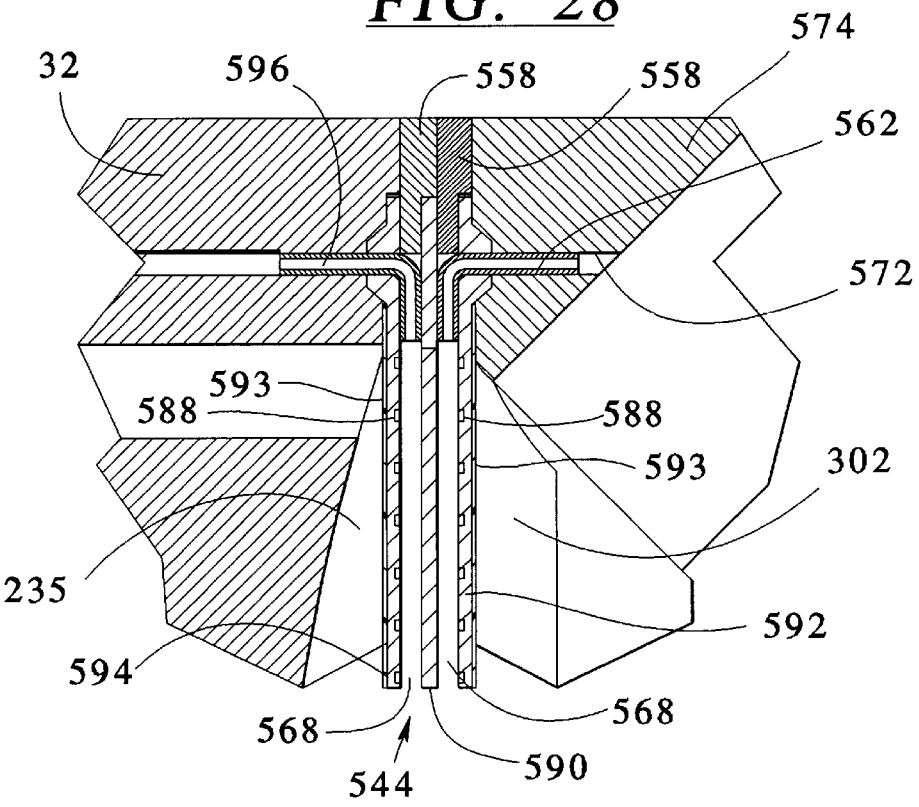
FIG. 28 is an elevated fragmentary cross-sectional view showing the mounting details for a double-sided leak detection diaphragm assembly in accordance with another preferred embodiment.

The diaphragms or diaphragm assemblies 288 for use in the new and improved pump 10 are shown in greater detail in FIGS. 24–30. Diaphragms 288 have a generally circular disc-shaped configuration. They are generally made from resilient flexible materials including elastomers and other thermoplastic materials such as fluoropolymers. The diaphragm may be made of a solid TeflonO type fluoropolymer material or may comprise a TeflonO faced elastomeric material. The diaphragms may be a standard single ply, such as diaphragms 540, shown in FIGS. 6–7 and 24; a double-ply leak detection diaphragm 542, shown in FIGS. 25–27; or a triple-ply double-sided leak detection diaphragm 544 as shown in FIG. 28 which is preferred.

As shown in FIG. 24 and elsewhere in the other Figures, single-ply diaphragm 540 comprises a generally circular disc of diaphragm material including a first major surface 546 adapted to face the hydraulic chamber 235 and an opposed second major surface 548 adapted to face the product chamber 302. A raised annular lip projection 550 is defined on surface 548 adjacent a peripheral edge of diaphragm 540. As shown in FIG. 24, lip projection 550 is sealingly engaged in an annular trapezoidal recess 552 provided in rear end 292 of product head 36. The front end 228 of pump head 32 may be provided with a pair of raised ridges 552 and 554 disposed about front opening 230 to provide improved holding power when diaphragm 540 is squeezed between product head 36 and pump head 32.

In accordance with a preferred embodiment, the diaphragm is a two-ply diaphragm assembly 542 provided with a leak detection system. More particularly and referring now to FIGS. 25–27, diaphragm assembly 542 includes a forward diaphragm 556, an annular spacer ring 558, a pair of L-shaped tubes 560, 562, and a rearward diaphragm 564. In the assembled condition shown in FIGS. 26 and 27, a gap 568 is provided between the forward diaphragm 556 and rearward diaphragm 564. Forward diaphragm 556 and rearward diaphragm 564 are sealably secured to spacer ring 558 with an adhesive. One end of each hollow tube 560 and 562 is disposed in gap 568 and the opposed end extends through lip projection 550 to connect with channels 570 and 572 provided in a modified product head 574 shown in FIG. 27. The radial thickness dimension of lip projection 550 is sufficiently large to provide better sealing performance and mechanical support for tubes 560, 562. Modified product head 574 includes a housing 576 extending from the front end 290 on product head 574. A vacuum or pressure gauge 578, a vacuum or pressure sensitive switch 580, or both, fluidly connected to channel 570, may be provided in housing 576. Housing 576 may include an exit opening 582 to permit an electrical or signal connection to be made from vacuum switch 580 to an alarm circuit, to a motor disable switch or to a digital logic controller operating pump 10. A lower closeable vacuum port 582 is connected to channel 572. A vacuum pump may be connected to port 582 and a vacuum or at least reduced pressure may be created in gap 568. The port 582 is then closed. In evacuated condition, the central portions of forward diaphragm 556 and rearward diaphragm 564 are pulled into face-to-face contact. A peripheral portion of gap 568 adjacent spacer ring 558 will remain even after evacuation. If either the forward diaphragm 556 or rearward diaphragm 564 perforates or develops a leak, the reduced pressure or vacuum in gap 568 will be lost which will trip vacuum switch 580 and/or be indicated on pressure gauge 578.

Figure 26:
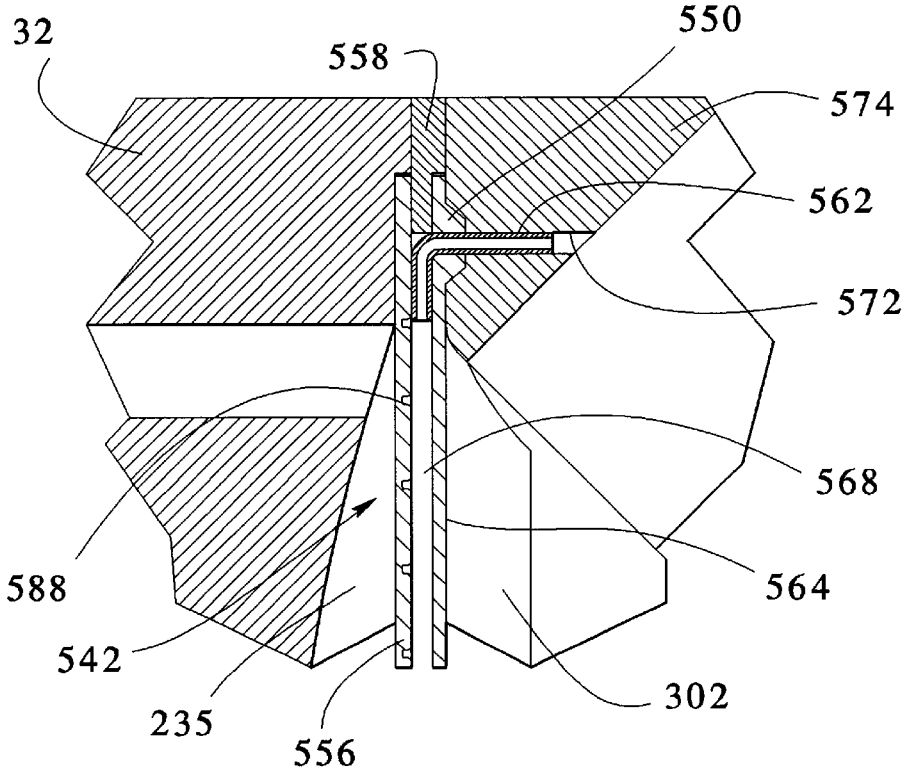
FIG. 26 is an elevated fragmentary cross-sectional view showing the mounting details for the leak detection diaphragm assembly of FIG. 25.

As shown in FIGS. 26 and 27, the rear end of product head and the front end of pump head are each provided with an aligned annular rectangular recess 582 and 584, respectively, adapted to receive the edge portions of the retainer ring 566. An annular adaptor ring 586 is also provided to close the space between the product head and pump head caused by the increased thickness dimension of diaphragm assembly 540.

Figure 29:
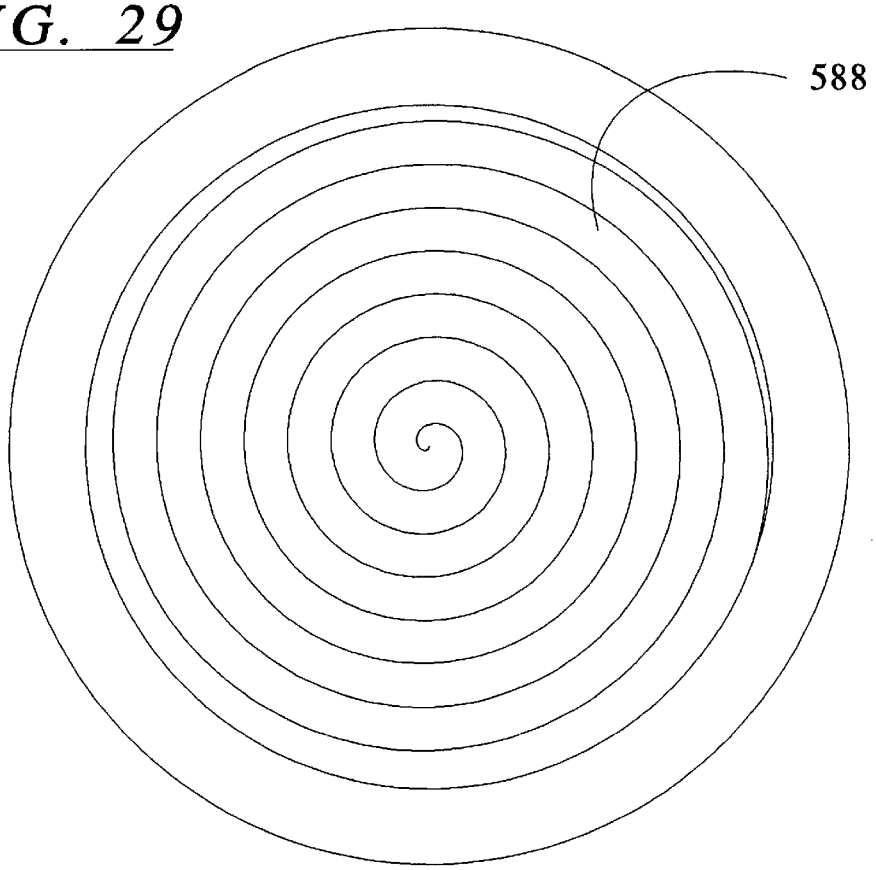
FIG. 29 is a top plan view of a preferred diaphragm member for use with the present invention including a fluid removing spiral groove defined in a major surface thereof.

In accordance with a preferred embodiment, at least one of the inner facing surfaces on diaphragm 556 or diaphragm 564, or both of them, are provided with a spiral groove 588 as shown in FIGS. 28–29. Spiral groove 588 functions to provide and maintain fluid communication between the central portions of the diaphragms and the vacuum switch 580 and/or vacuum gauge 578 to provide early and reliable detection of a loss of vacuum caused by diaphragm failure.

Referring now to FIG. 28, the three-ply double-sided leak detection diaphragm assembly 544 is shown. Diaphragm assembly 544 includes a central diaphragm 590, a forward diaphragm 592 and a rearward diaphragm 594. Two spacer rings such as 558 and two additional L-shaped tubes 596 are added between middle diaphragm 588 and forward diaphragm 590 which are joined to L-shaped channels provided in a modified pump head. A second pressure switch/gauge housing and vacuum port can be attached to side exits provided in the pump head, as will be readily apparent to those skilled in this art. In most other respects, the components and construction of diaphragm assembly 544 is similar to diaphragm assembly 542 described above. The three-ply double-sided leak detection diaphragm assembly 544 provides the additional advantage of identifying which diaphragm is leaking. In accordance with the preferred embodiment, at least one diaphragm in each pair is provided with a spiral groove 588. A major advantage provided by the present invention is that the various diaphragms may be interchanged and readily mounted in the same product head.

Referring now to FIGS. 8–10, 12(*a*) and 12(*b*), a new and improved diaphragm metering pump in accordance with another embodiment of the invention, generally referred to by reference numeral 600 is shown. Pump 600 is similar to pump 10 in almost every detail except that pump 600 is provided with an electronic control system.

More particularly as shown in the drawings, pump 600 includes an electrical housing 602 extending rearwardly from and mounted to upper end of pump housing 20 and a user keypad 604 mounted alongside the front end of pump housing 20. User keypad 604 includes a keyed data entry portion 606 and a user to machine interface such as LCD display 608. Pump operation is placed under the command of a microprocessor based digital logic controller 610 mounted within electrical housing 602. Digital logic controller (DLC) 610 includes a plurality of printed circuit boards 612 and a plurality of board mounted components generally indicated at 614 including various input/output connectors and, of course, a microprocessor. In a preferred embodiment, DLC 610 includes an edge card connector for receiving a user edge card so that system controls may be sent and received from a remote user source such as, a laptop computer, a computer or other controller communicating via a modem or the like.

Figure 31:
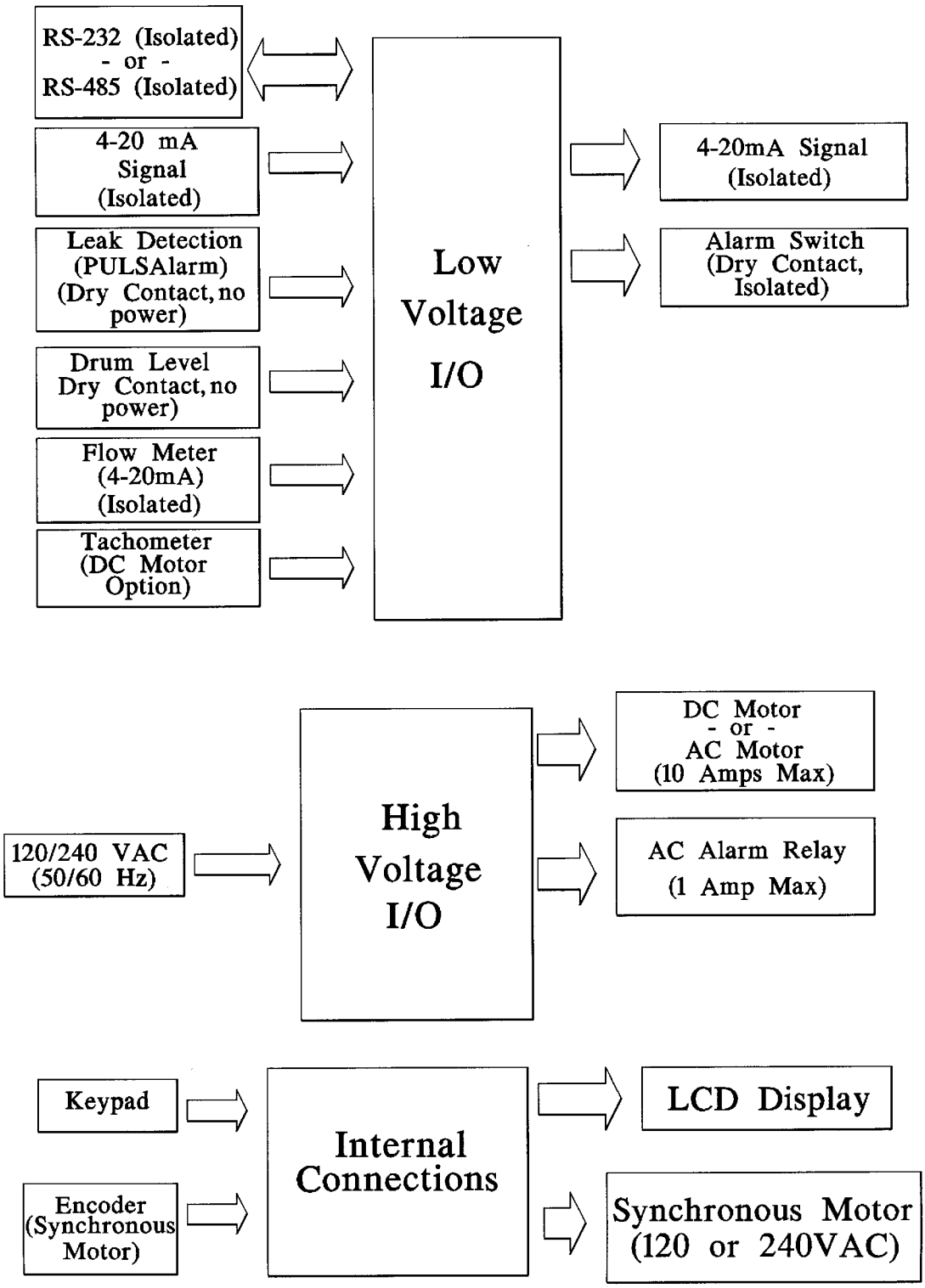
FIG. 31 is a schematic flow chart showing the electrical connections for an electronically controlled diaphragm metering pump in accordance with a preferred embodiment.
Figure 35:
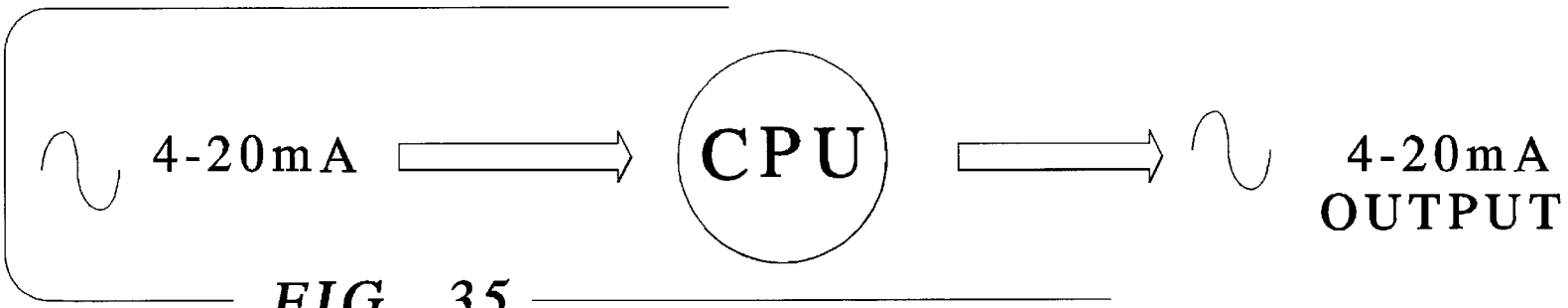
FIG. 35 is a schematic diagram of the signal output in accordance with a preferred embodiment.

DLC 610 may be provided with the inputs and outputs shown in FIGS. 31 and 35. For example, as shown in FIG. 34, a signal input from vacuum switch 580 may be provided to indicate when a diaphragm failure has occurred. In response to a failure, the DLC 610 can stop the motor 12 and sound an alarm. A drum level sensor provided in a product drum can provide a signal when the level of product fluid is low or when the drum is empty. In response, the DLC 610 can activate an alarm or stop the pump motor 17 or both. A flow meter may be installed in the product outlet 42 to provide signal information regarding the quantity of fluid pumped or the flow rate in gallons/hour or liters/hour to the DLC 610. In a no flow or under flow condition, the DLC 610 can activate an alarm, stop the pump or both. The signal information from a flow meter may also be used to calibrate the pump, to give a calibration curve of actual flow rate as a function of motor speed or percentage of stroke length or both.

Figure 33:
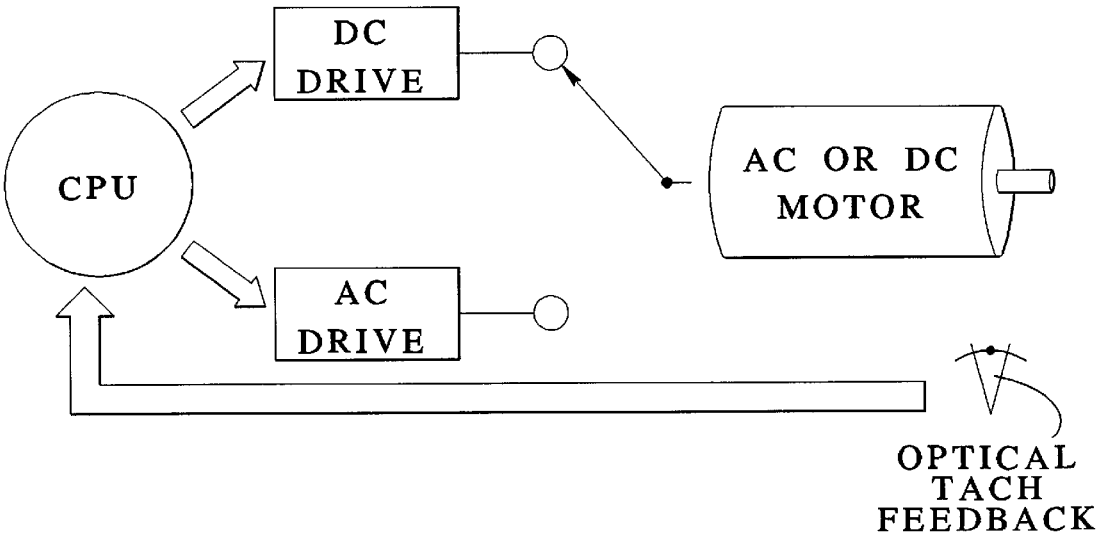
FIG. 33 is a schematic diagram of an electronic motor speed control circuit in accordance with a preferred embodiment.

An optical tachometer may be used to provide signal information regarding motor speed which may be used by the DLC 610 in regulating motor speed as shown in FIG. 33.

Figure 32:
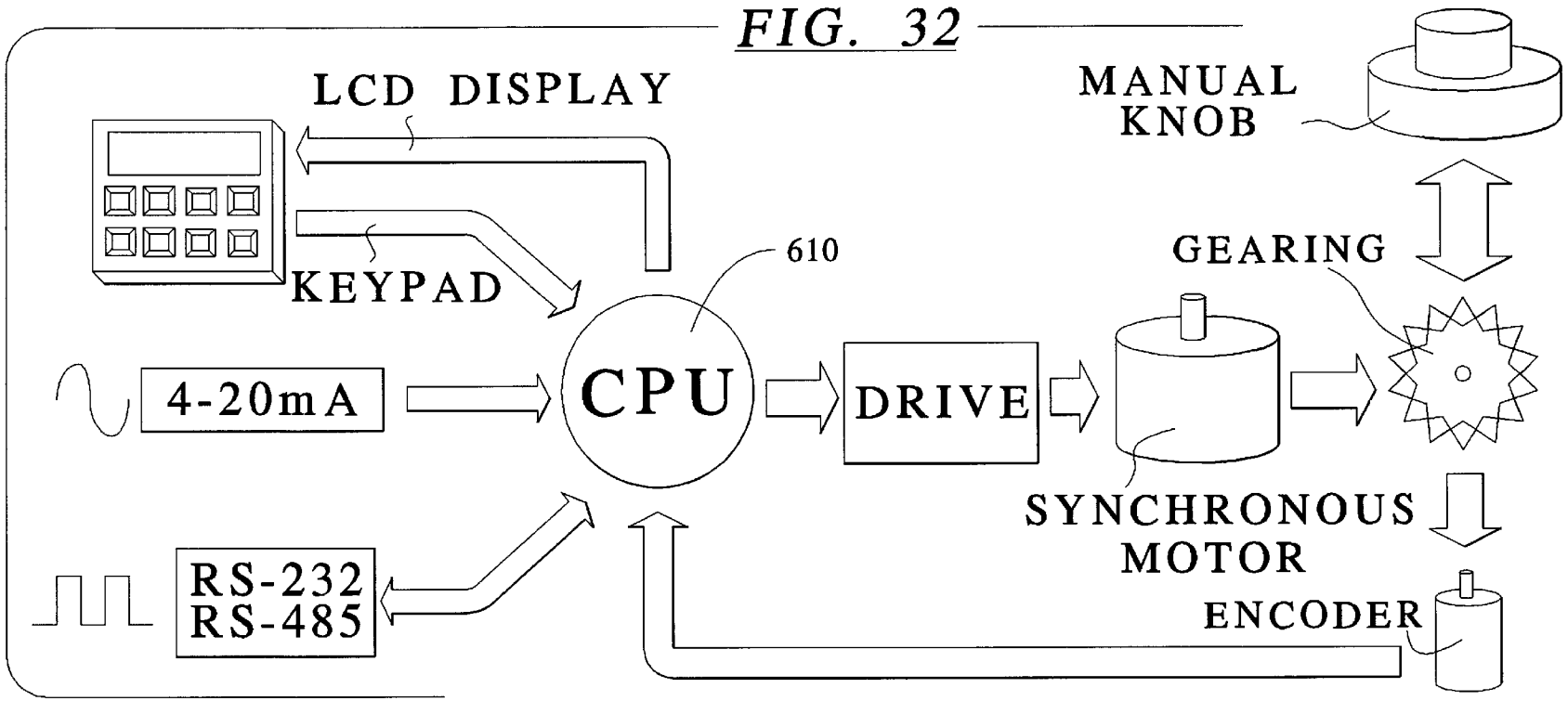
FIG. 32 is a schematic flow chart showing the component parts of an electronically controlled or manually controlled stroke length adjustment system in accordance with a preferred embodiment.

As shown in FIG. 32, the stroke length adjustment assembly may also be electronically controlled by the DLC 610. The DLC 610 can send signals to a synchronous motor having an encoder for rotating shaft 352 to adjust stroke length.

In accordance with a preferred embodiment, operation of pump 600 may be electronically controlled to turn the pump on or off at certain times and/or for desired periods of time. Pump 600 can be set to run and deliver a total amount of fluid. Alternatively, it may be set to add controlled amounts of fluid in timed increments in the form of batch processing. The pump may also be set to deliver fluid at a first rate for a first time period followed by a second flow rate for a second period. It can be appreciated that such electronic control provided by DLC 610 improves the ease and flexibility of using the pump 600.

In greater detail and referring now to FIGS. 36–41, operation of pump 600 is placed under the command of a microprocessor based digital logic controller 610 mounted within an enclosure 602. Both the digital logic controller (DLC) and its enclosure are designed to properly operate only when mounted atop the new and improved diaphragm metering pump 600.

The digital logic controller (DLC) 610 preferably consists of four interconnected circuit boards 612, electronic components mounted to these boards 614, a commercially available liquid crystal display 608 with its own printed circuit board, a nine key keypad 604, a synchronous motor, and an absolute encoder. All items are completely housed within the dedicated enclosure 602, such that seepage or penetration of foreign material is not permitted under normal operation conditions. The top view of the enclosed DLC 610 mounted to a diaphragm metering pump 600 is provided by FIG. 39. FIG. 39 indicates the outline of DLC 610 in bold. The visible keypad 604 and display 608 are on a higher level than the remainder of the enclosure 602.

DLC 610 is designed to control pump flow rate by precisely adjusting the rotatable stroke length shaft 352 extending from the pump. The stroke length actuator consists of a synchronous motor powered by the DLC to operate bi-directionally so that the precise position of stroke length is attained. Position feedback is obtained using an integral absolute encoder. This relationship is diagrammed in FIG. 33. The liquid crystal display 608 can be controlled to indicate pump flow as a percentage flow or units of flow rate. Keypad 604 allows the user to affect operation of the pump in several ways.

Motor operation is illustrated by FIG. 34. The standard DLC configuration is for an AC motor drive to power the pump motor. When factory configured to control a DC motor to drive the pump 600, the DLC may attain greater turndown precision of pump flow by adjusting both stroke length position and motor speed. DC motor speed control is an option to the standard DLC configuration and employs an optical tachometer feedback.

One of the four integral printed circuit boards 612 indicated as the connector board 620 allows for field wiring connections to be made by the customer. Connector board 620 is housed in the rearward portion of the enclosure as shown in FIG. 39. Conduit fittings 622 are provided at this location for the passageway of all field wiring connection. A portion of the enclosure atop the connector board 620 consists of a removable plate 624. The plate 624 is secured in place during normal operation while power if applied such that seepage or penetration of foreign material is not permitted. When power is not applied, plate 624 may be removed by the customer to gain access to the field wiring connections.

When power is not applied, the DLC 610 and enclosure 602 may be separated into two pieces by unbolting the enclosure from the pump 600. The main body of the DLC 610 can be separated from the connector board 620.

Figure 38:
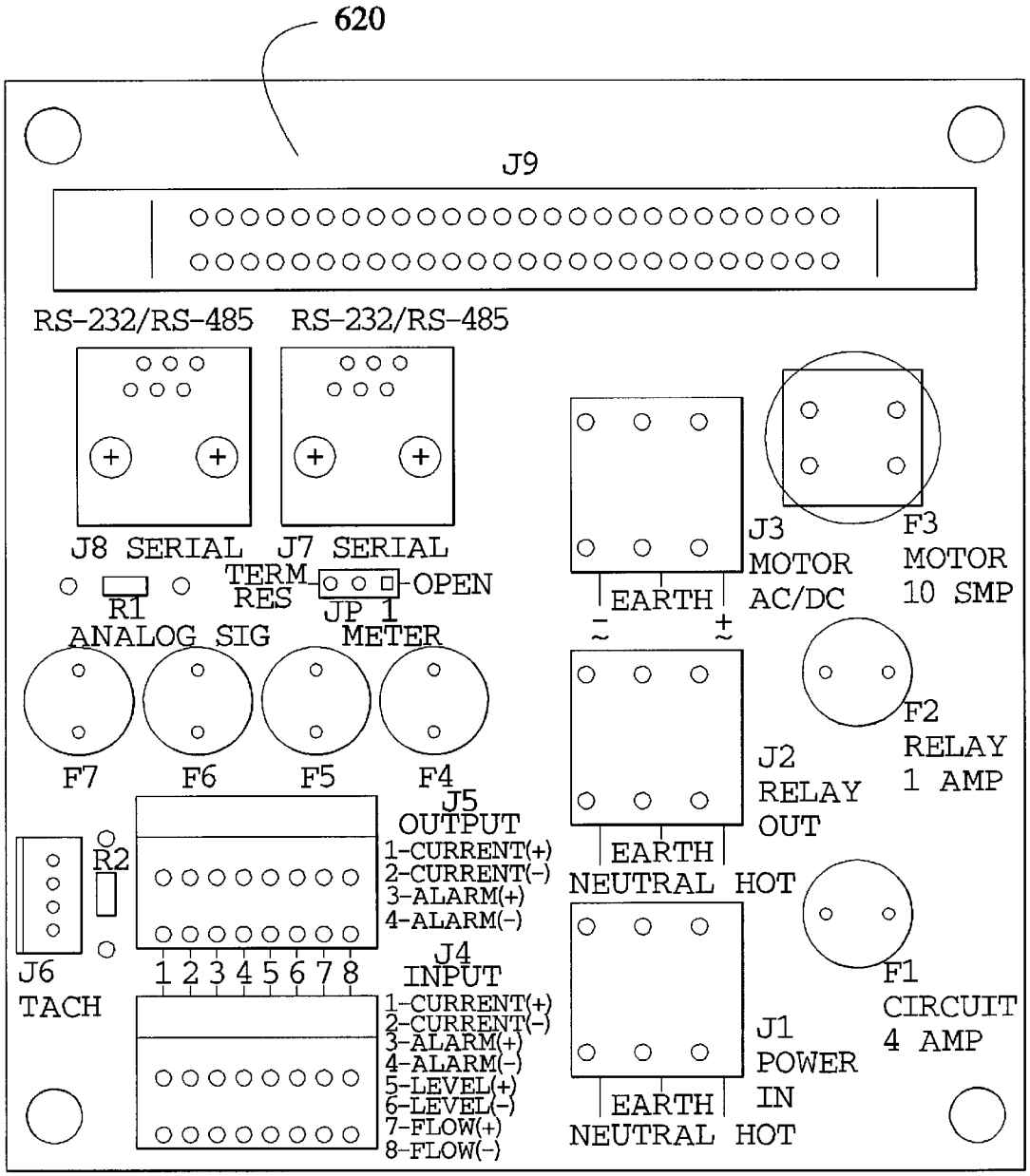
FIG. 38 is a top plan view of a new and improved connector board for the digital logic controller in the electronically controlled diaphragm metering pump in accordance with a preferred embodiment.
Figure 41:
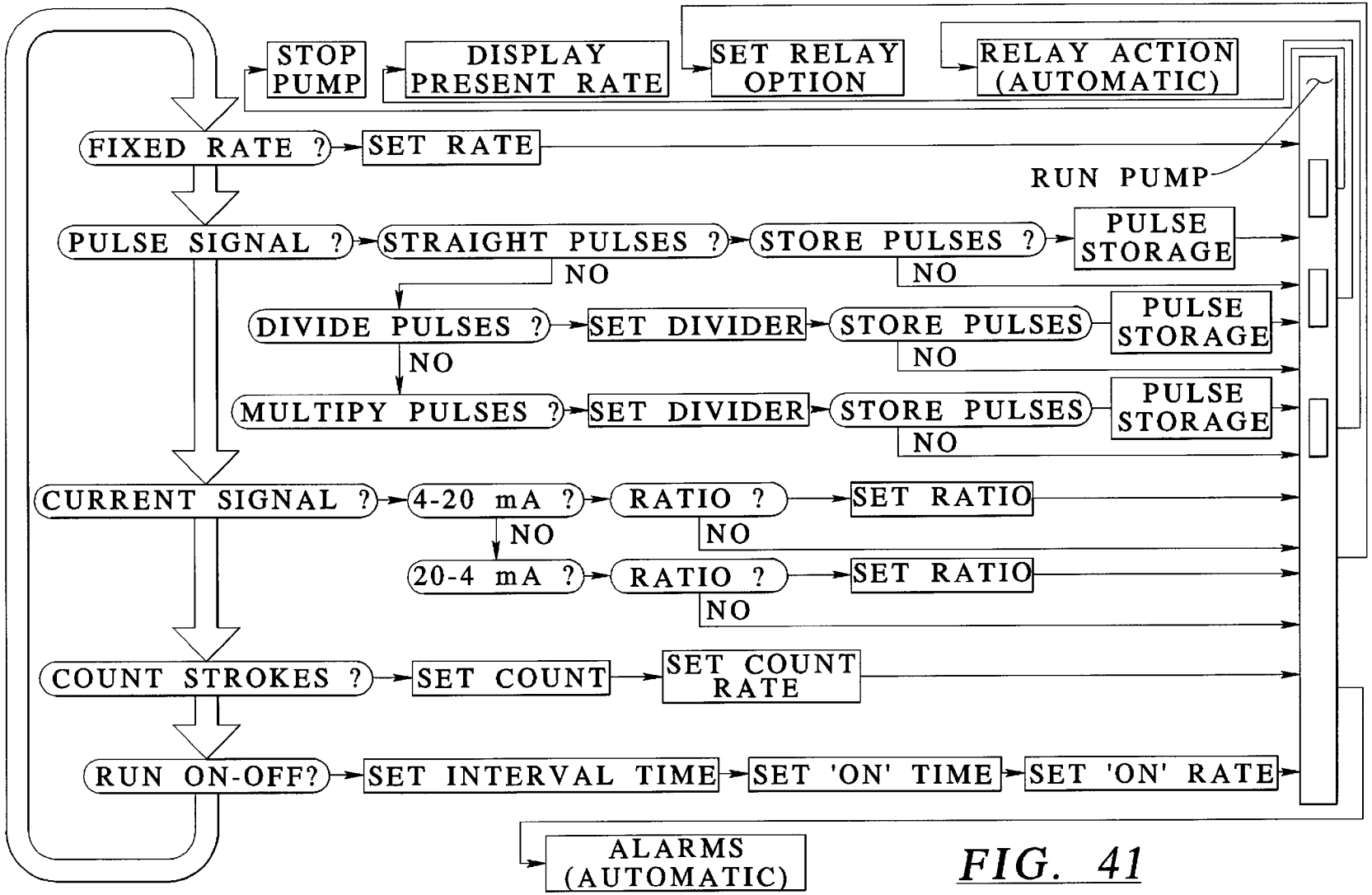
FIG. 41 is a schematic flow chart diagram of the relay logic for the digital logic controller in the electronically controlled diaphragm metering pump in accordance with a preferred embodiment.

The connector board silkscreening is shown in FIG. 38. The connector board 620 contains an edge card socket at location J9. This interfaces with the plug board shown in FIG. 40. The plug board is secured to the main body of the DLC enclosure such that it is retained by the main body when disconnection occurs. This method of disconnection allows the main body of the DLC to be replaced with upgraded or undamaged DLC units. This method of disconnection provides design modularity as it allows the main body to be unplugged from the Connector Board without upsetting the field wiring connections. This method of disconnection reduces the involvement of the customer in servicing failures or damage of electronic componentry. It is not intended that the user should access the main body of the enclosure for any reason.

Referring again to FIG. 38, high voltage connection points are to the right of center of board. Low voltage connection points are to the left of center of board. Connector J1 allows for the power source to be connected. Connector J2 allows for an optional relay to be powered as an alarm condition response. Connector J3 allows the pump motor to be attached to and powered by the DLC. Under normal operating conditions, the DLC will activate the pump motor and relay as dictated by integral proprietary software. Low voltage connector J4 allows for the input of: an analog process signal such as a 4 to 20 milliamp signal; a leak detection input for the pump diaphragm failure alarm; a level indicator for low drum level alarm conditions; a flowmeter input. Low voltage output connector J5 allows for: an analog output signal such as a 4 to 20 milliamp signal; alarm status indicator for potential usage with programmable logic controllers. Connector J6 allows for attachment of a tachometer for those DLC units configured to control the speed of a DC motor to drive the pump. Modular jacks J7 and J8 allow for the connection of serial communication lines to personal computers, laptops, modems, or other DLC units.

FIG. 36 illustrates the keypad 604 and display 608 of the DLC. The keypad 604 and display 608 comprise the complete user interface for local control of pump operation. The display consists of a 2×16 character (two lines of sixteen characters per line) screen. The display is backlit so that information may be see in low light conditions. The keypad resides below the display and includes nine keys: Motor, Menu, Units, Batch, Calibration, Mode, Up Arrow, Down Arrow, and Enter. These keys establish all local control operations.

The DLC has an integral software program that allows the user to establish flexible configurations to meet their system requirements. A flow chart showing the relay logic is provided in FIG. 41. The DLC together with the software can perform many functions and operations. The motor key allows the user to activate/deactivate the pump motor at any time. This is intended to add convenience. It is not intended to replace a safety stop switch where one is required.

The Menu key allows the user to access many DLC parameters. These parameters include: diagnostic recordings of system failures; date and time settings; desired responses to analog input signal failure; desired response to leak detection; desired response to low drum level; desired response to power failure; the normal status of the alarm relay; a security pin number to prevent unauthorized access; decimal format for American or European styles; the LCD display contrast; serial communication band rate and address; language choice of English, French, German, or Spanish; a factory reset command.

The Units key allows the user to switch between displayed units of flow rate. Units are displayed in Gallons Per Hour (GPH), Liters Per Hour (LPH), Cubic Centimeters Per Hour (CCH), Gallons Per Minute (GPM), Liters Per Minute (LPM), Cubic Centimeters Per Minute (CCM), and percentage of max flow (%).

The Batch key allows the user to access batch setup. Up to three separate batches may be configured for preset date and time. Each batch may be individually set to a desired flow rate and duration. Each batch may be individually configured to repeat after a specified off time duration.

The Calibration key allows the user to calibrate displayed pump flow, the analog input signal, and the analog output signal. Pump flow is factory calibrated prior to shipment. The user may recalibrate the displayed pump flow over a span one to five points. The user specifies the number of points to calibrate the pump flow to. When all five points are chosen, calibration occurs at stroke length positions of 10%, 25%, 50%, 75% and 100%. For each point the DLC adjusts to the corresponding stroke length position and then automatically shuts the pump motor off. The user is prompted to measure a specified volume and to press the Enter key when ready. When the Enter key is depressed, the pump motor is activated for one minute in duration during which a countdown timer is displayed. After one minute, the user is prompted to enter his newly measured volume. This procedure is repeated for each point to be calibrated. Upon completion and confirmation of all points, the DLC automatically computes in linear regression methodology the closest linear straight line curve for all values.

The calibration of the analog input signal is achieved by prompting the user to input the analog signal for 0% pump flow rate followed by the analog signal for 100% pump flow rate. In a typical 4 to 20 milliamp application, the user would input 4 milliamps at the 0% signal prompt and 20 milliamps at the 100% signal prompt. Reverse acting signals are achieved by reversing this order (i.e., the higher signal is applied at the 0% prompt). Split ranging is accomplished by the same procedure. For example, if a 4 to 12 milliamp signal is to specify a full scale, then 4 milliamps is input for 0% and 12 milliamps is applied at 100%. Ratiometric control is accomplished by adjusting the percentage output flow for the maximum analog input. For example, the maximum analog input of 20 milliamps could be rationed down to 50%. All analog input up to 20 milliamps would adjust pump flow up to 50%. This method of calibration allows great flexibility in user requirements. It also eases calibration of pump flow significantly by recording the inputted analog signal values at the touch of a button. No longer are potentiometers required to calibrate analog signal ranges. Also revolutionary is the display of current input in units of milliamps. This precludes the need for extra equipment such as multimeters or ammeter scales.

The analog output signal may be calibrated to vary the signal output strength at 0% and 100%.

The Mode key allows the user to switch between manual and analog modes. During manual mode, the user changes pump flow rate by depressing the Up or Down Arrow keys. During analog mode, the analog input signal controls the pump flow rate from an external source.

Although the present invention has been described with reference to certain preferred embodiments, modifications or changes may be made therein by those skilled in the art without departing from the scope and spirit of the present invention as defined by the appended claims.

What is claimed is:

1. A diaphragm metering pump comprising:

a pumping section including a one-way product flow passageway having an inlet end with a one-way inlet valve and an outlet end with a one-way outlet valve, a diaphragm member disposed between an opening in the one-way product flow passageway and a hydraulic chamber filled with hydraulic fluid, means for varying hydraulic pressure in the hydraulic chamber to cause pumping displacements of the diaphragm member, a hydraulic refill valve disposed in fluid communication with the hydraulic chamber and connected to a supply of hydraulic fluid and operative to introduce hydraulic fluid into the hydraulic chamber when fluid pressure in the hydraulic chamber falls below a lower limit, and a shuttle-type air bleeder valve disposed in fluid communication with an upper end of the hydraulic chamber and operative in response to relative increase in fluid pressure conditions in said hydraulic chamber to release a small amount of air or hydraulic fluid from the hydraulic chamber, said air bleeder valve further including means for selectively maintaining the bleeder valve in an open condition such that in an increasing fluid pressure condition in said hydraulic chamber relatively larger amounts of air or hydraulic fluid may be released from the hydraulic chamber through the bleeder valve which in turn causes new hydraulic fluid to enter the hydraulic chamber through the hydraulic refill valve in response to a relative decrease in fluid pressure conditions in said hydraulic chamber below said lower limit, thereby providing an automatically self-priming hydraulic chamber.

2. A diaphragm metering pump as defined in claim 1, wherein said shuttle-type air bleeder valve comprises a valve housing including an inlet opening in a lower end thereof, a side exit opening spaced upwardly from said inlet opening, a valve chamber including a lower valve seat adjacent the inlet opening and an upper valve seat disposed between the lower valve seat and the exit opening, a ball check in the valve chamber movable between said lower valve seat and the upper valve seat, a valve pin movably mounted in the valve housing having an end portion extending through the upper seat into said valve chamber, said valve pin being normally movable with the ball check as the ball check moves between said upper and lower seats and means for selectively limiting upward movement of the valve pin to prevent the ball check from seating on the upper valve seat to maintain the valve in an open priming condition, the inlet opening of said valve housing being fluidly connected to an upper portion of said hydraulic chamber.

3. A diaphragm metering pump as defined in claim 1, wherein the means for selectively maintaining is manually controlled.

4. diaphragm metering pump comprising:

a pumping section including a one-way product flow passageway having an inlet end with a one-way inlet valve and an outlet end with a one-way outlet valve, a diaphragm member disposed between an opening in a one-way product flow passageway and a hydraulic chamber filled with hydraulic fluid, means for varying hydraulic pressure in the hydraulic chamber to cause pumping displacements of the diaphragm member, a hydraulic refill valve disposed in fluid communication with the hydraulic chamber and connected to a supply of hydraulic fluid and operative to introduce hydraulic fluid into the hydraulic chamber when fluid pressure in the hydraulic chamber falls below a lower limit, and a shuttle-type air bleeder valve comprising a valve housing including an inlet opening in a lower end thereof, a side exit opening spaced upwardly from said inlet opening, a valve chamber including a lower valve seat adjacent the inlet opening and an upper valve seat disposed between the lower valve seat and the exit opening, a ball check in the valve chamber movable between said lower valve seat and the upper valve seat, a valve pin movably mounted in the valve housing having an end portion extending through the upper seat into said valve chamber, said valve pin being normally movable with the ball check as the ball check moves between said upper and lower seats and means for selectively limiting upward movement of the valve pin to prevent the ball check from seating on the upper valve seat to maintain the valve in an open priming condition, the inlet opening of said valve housing being fluidly connected to an upper portion of said hydraulic chamber.

* * * * *